US011591829B2

(12) United States Patent
Maeda

(10) Patent No.: US 11,591,829 B2
(45) Date of Patent: Feb. 28, 2023

(54) LID OPENING AND CLOSING DEVICE FOR VEHICLE

(71) Applicant: KABUSHIKI KAISHA HONDA LOCK, Miyazaki (JP)

(72) Inventor: Naruhiko Maeda, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 0 days.

(21) Appl. No.: 17/162,280

(22) Filed: Jan. 29, 2021

(65) Prior Publication Data

US 2021/0270063 A1 Sep. 2, 2021

(30) Foreign Application Priority Data

Feb. 27, 2020 (JP) ..... JP2020-031607

(51) Int. Cl.

| | |
|---|---|
| ***E05B 63/00*** | (2006.01) |
| ***E05B 77/34*** | (2014.01) |
| ***E05B 79/12*** | (2014.01) |
| ***E05B 81/14*** | (2014.01) |
| ***E05B 83/34*** | (2014.01) |

(52) U.S. Cl.

CPC ..... *E05B 81/14* (2013.01); *E05B 63/0069* (2013.01); *E05B 77/34* (2013.01); *E05B 79/12* (2013.01); *E05B 83/34* (2013.01); *E05Y 2900/534* (2013.01)

(58) Field of Classification Search

CPC ..... E05B 81/14; E05B 63/0069; E05B 77/34; E05B 79/12; E05B 83/34; E05B 79/20; E05B 81/06; E05B 81/90; E05Y 2900/534; B60K 15/05; B60K 2015/0515

See application file for complete search history.

(56) References Cited

U.S. PATENT DOCUMENTS

| | | | | |
|---|---|---|---|---|
| 5,222,774 | A | 6/1993 | Fukumoto et al. | |
| 8,845,001 | B2 * | 9/2014 | Kotama | B60Q 3/14 296/97.22 |
| 9,567,779 | B2 * | 2/2017 | Niwa | E05B 83/34 |

FOREIGN PATENT DOCUMENTS

| | | |
|---|---|---|
| JP | 3079611 B2 | 8/2000 |
| JP | 2007-153155 A | 6/2007 |

* cited by examiner

*Primary Examiner* — Christine M Mills
*Assistant Examiner* — Thomas L Neubauer
(74) *Attorney, Agent, or Firm* — Carrier Shende & Associates, P.C.; Joseph P. Carrier; Fulchand P. Shende

(57) ABSTRACT

In a lid opening and closing device for a vehicle, a restriction member restricting movement of a rod and an electric motor driving the restriction member are housed in a case fixed to a vehicle body outer plate. An emergency operation member extends movably through a vehicle body inner plate while enabling the restriction member to move when the electric motor malfunctions, the emergency operation member being resiliently urged toward an initial position side at least when being operated. A grommet for preventing intrusion of water is provided between the emergency operation member and the vehicle body inner plate. The grommet includes a grommet main portion liquid-tightly mounted on the vehicle body inner plate while having the emergency operation member movably inserted therethrough, and an elastic portion integrally connected to the grommet main portion while enabling the emergency operation member to be resiliently urged toward the initial position side.

4 Claims, 21 Drawing Sheets

LID OPENING AND CLOSING DEVICE FOR VEHICLE

CROSS REFERENCE TO RELATED APPLICATIONS

The present application claims priority under 35 U.S.C. § 119 to Japanese Patent Application No. 2020-31607 filed Feb. 27, 2020 the entire contents of which are hereby incorporated by reference.

BACKGROUND OF THE INVENTION

Field of the Invention

The present invention relates to a lid opening and closing device for a vehicle, comprising a rod capable of moving forward and backward between a pushed-in position where a lid openably and closably supported on a vehicle body outer plate is pushed in and a protruding position where the lid is in an open state, a restriction member that can operate between a restriction position where movement of the rod in a state in which the lid is at a closed position is restricted and a restriction release position where the restriction is released, an electric motor driving the restriction member between the restriction position and the restriction release position, a case housing the restriction member and the electric motor and fixed to the vehicle body outer plate, an emergency operation member extending movably through a vehicle body inner plate while enabling the restriction member to move to the restriction release position when the electric motor malfunctions, and a grommet provided between the emergency operation member and the vehicle body inner plate so as to be capable of preventing water from entering between the vehicle body outer plate and the vehicle body inner plate, the emergency operation member being resiliently urged toward an initial position side at least when being operated.

Description of the Related Art

Such a lid opening and closing device for a vehicle is already known from for example Japanese Patent Application Laid-open No. 2007-153155; in this arrangement, a grommet is provided between a lock base (corresponding to the vehicle body inner plate of the invention of the present application) and a lid cable (corresponding to the emergency operation member of the invention of the present application). Furthermore, a structure in which a spring for resiliently urging an emergency operation member toward an initial position is housed within a case is disclosed by Japanese Patent No. 3079611.

In order to prevent water from entering between a vehicle body outer plate to which a case is fixed and a vehicle body inner plate through which an emergency operation member movably extends, if the arrangement is such that a grommet is attached to the vehicle body inner plate as disclosed in Japanese Patent Application Laid-open No. 2007-153155 and, moreover, a spring resiliently urging the emergency operation member toward the initial position side is housed within the case as disclosed in Japanese Patent No. 3079611, not only does the number of components increase, but the number of assembly steps also increases, which is a problem.

SUMMARY OF THE INVENTION

The present invention has been accomplished in light of such circumstances, and it is an object thereof to provide a lid opening and closing device for a vehicle that enables the number of components and the number of assembly steps to be decreased.

In order to achieve the object, according to a first aspect of the present invention, there is provided a lid opening and closing device for a vehicle, comprising a rod capable of moving forward and backward between a pushed-in position where a lid openably and closably supported on a vehicle body outer plate is pushed in and a protruding position where the lid is in an open state, a restriction member that can operate between a restriction position where movement of the rod in a state in which the lid is at a closed position is restricted and a restriction release position where the restriction is released, an electric motor driving the restriction member between the restriction position and the restriction release position, a case housing the restriction member and the electric motor and fixed to the vehicle body outer plate, an emergency operation member extending movably through a vehicle body inner plate while enabling the restriction member to move to the restriction release position when the electric motor malfunctions, and a grommet provided between the emergency operation member and the vehicle body inner plate so as to be capable of preventing water from entering between the vehicle body outer plate and the vehicle body inner plate, the emergency operation member being resiliently urged toward an initial position side at least when being operated, wherein the grommet comprises a grommet main portion liquid-tightly mounted on the vehicle body inner plate while having the emergency operation member movably inserted therethrough, and an elastic portion integrally connected to the grommet main portion while enabling the emergency operation member to be resiliently urged toward the initial position side.

In accordance with the first aspect of the present invention, since the grommet provided between the vehicle body inner plate and the emergency operation member is formed from the grommet main portion mounted on the vehicle body inner plate and the elastic portion integrally connected to the grommet main portion, it becomes unnecessary to prepare an elastic member other than the grommet, thus reducing the number of components, and it is also unnecessary to assemble an elastic member within the case, thus reducing the number of assembly steps.

According to a second aspect of the present invention, in addition to the first aspect, the elastic portion integrally has a bellows portion and a cylindrical press fit tube portion, the bellows portion being formed into a bellows shape so as to cover part of the emergency operation member, the bellows portion having one end part thereof integrally connected to the grommet main portion, and the press fit tube portion being formed on another end part of the bellows portion and having the emergency operation member press fitted into the press fit tube portion.

In accordance with the second aspect of the present invention, since the elastic portion of the grommet is formed from the bellows portion covering part of the emergency operation member, and the cylindrical press fit tube portion integrally connected to the bellows portion and having the emergency operation member press fitted thereinto, due to the grommet main portion being liquid-tightly mounted on the vehicle body inner plate a seal is provided between the grommet and the vehicle body inner plate, and due to the emergency operation member being press fitted into the elastic portion covering the emergency operation member, the grommet is fixed to the emergency operation member, and a seal is provided between the emergency operation member and the grommet, thus enabling reliable waterproofness to be obtained.

The above and other objects, characteristics and advantages of the present invention will be clear from detailed descriptions of the preferred embodiment which will be provided below while referring to the attached drawings.

DESCRIPTION OF THE PREFERRED EMBODIMENT

Figure 1:
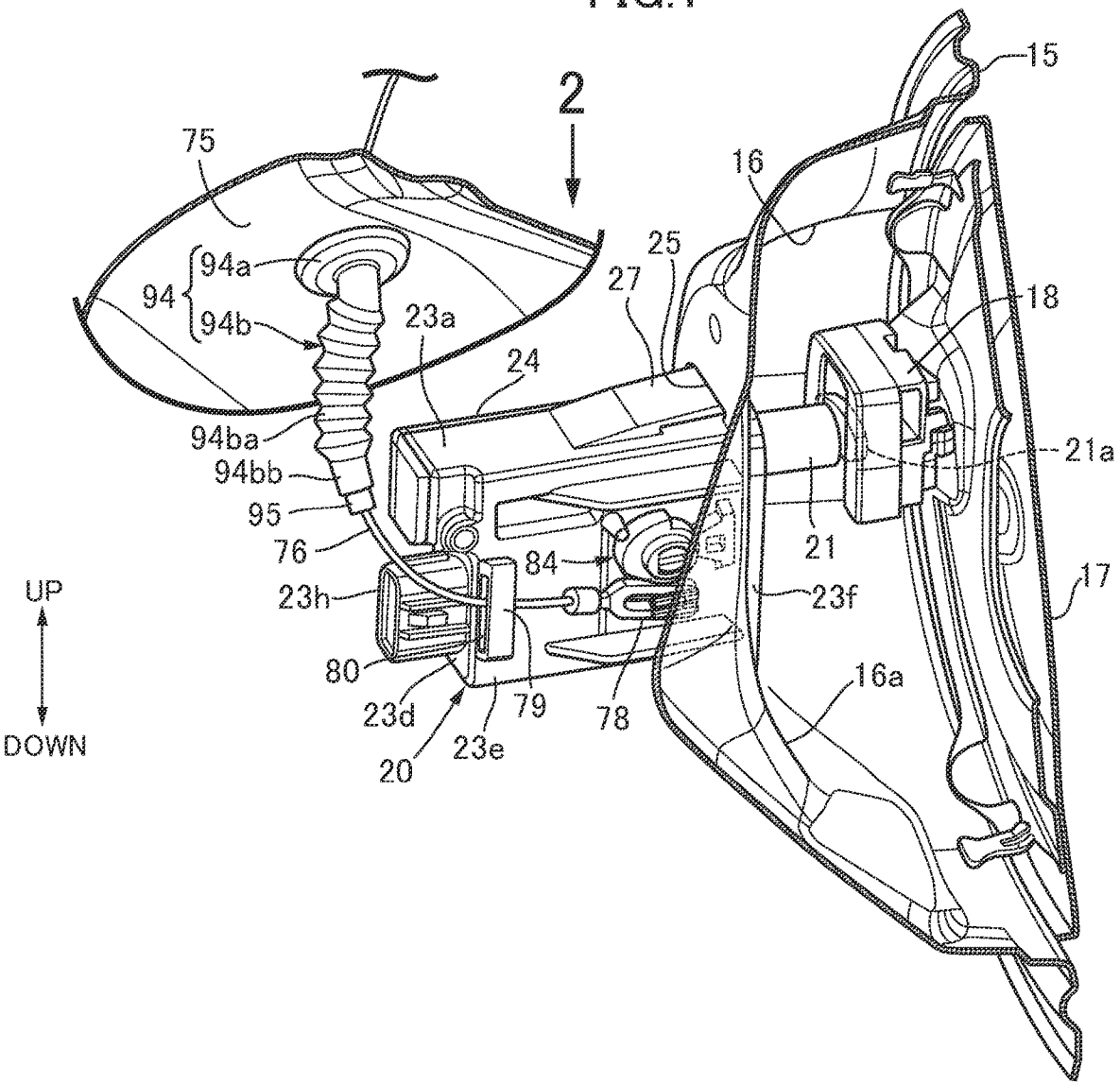
FIG. 1 is a perspective view showing a state in which a lid opening and closing device is mounted while a vehicle body outer plate and a vehicle body inner plate are cut away.
Figure 2:
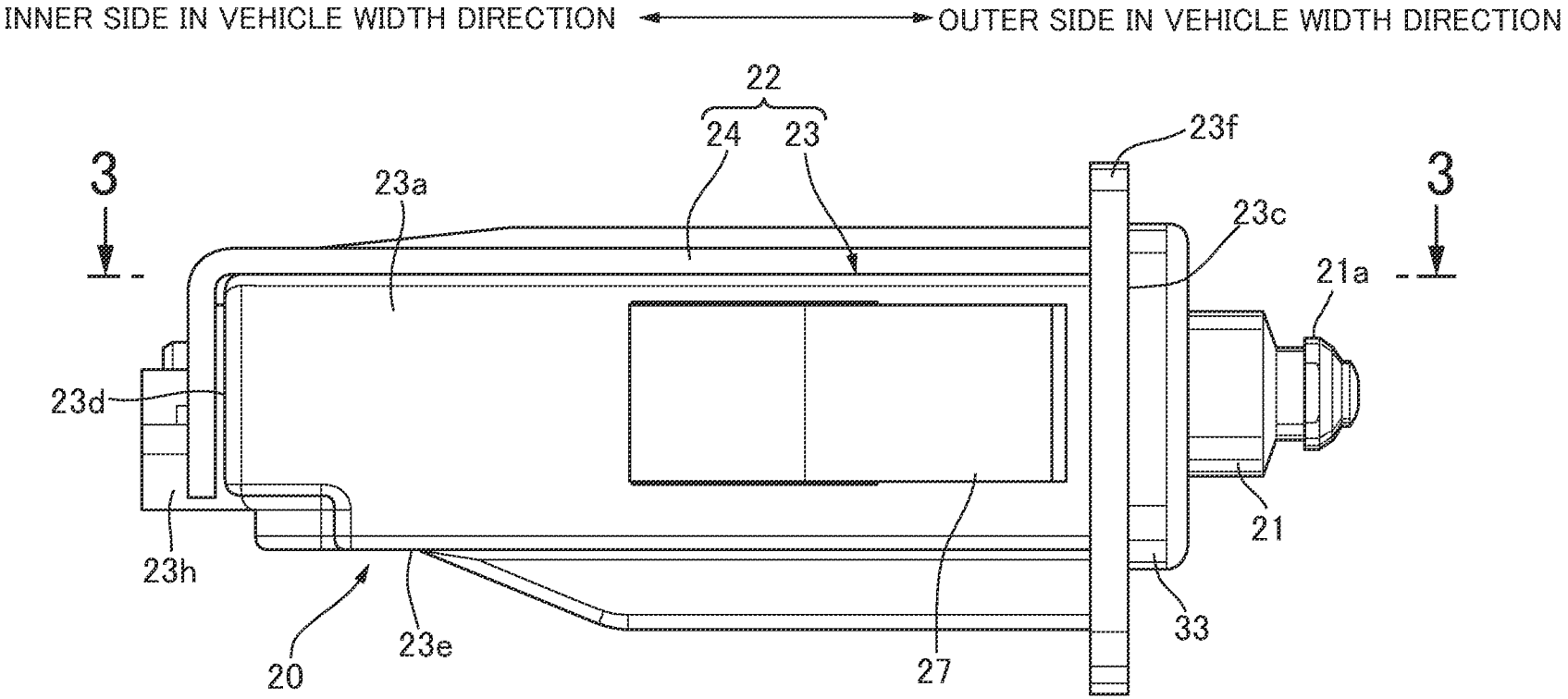
FIG. 2 is a plan view of the lid opening and closing device from the direction of arrow 2 in FIG. 1 when a rod is at a lid closed position.

An embodiment of the present invention is explained by reference to FIG. 1 to FIG. 21C; first, in FIG. 1, a recess part 16 is formed in a vehicle body outer plate 15 of a vehicle, a fuel supply part, which is not illustrated, facing the recess part 16, and a base end part of a lid 17 is pivotably supported on the vehicle body outer plate 15, the lid 17 being capable of opening and closing the recess part 16. A latching part 18 is provided on an inner face on a free end side of the lid 17, and a case 22 of a lid opening and closing device 20 is mounted on a bottom wall 16*a* of the recess part 16, the lid opening and closing device 20 having a rod 21, and an engagement portion 21*a* that detachably engages with the latching part 18 being provided on the tip end part of the rod 21. That is, the lid 17 is pivotably supported on the vehicle body outer plate 15, and the case 22 is mounted thereon.

Referring in addition to FIG. 2 to FIG. 6, the case 22 is formed from a rectangular box-shaped case main body 23 and a cover 24 joined to the case main body 23 so as to close an open end of the case main body 23.

The case main body 23 integrally has an upper side wall 23*a* and lower side wall 23*b* extending in the vehicle width direction across a gap in the up-down direction, an outer side wall 23*c* extending in the up-down direction while joining outer end parts in the vehicle width direction of the upper and lower side walls 23*a*, 23*b*, an inner side wall 23*d* extending in the up-down direction while joining inner end parts in the vehicle width direction of the upper and lower side walls 23*a*, 23*b*, and a flat plate-shaped end wall 23*e* connected in common to end parts on one side along the vehicle fore-and-aft direction of the upper side wall 23*a*, the lower side wall 23*b*, the outer side wall 23*c*, and the inner side wall 23*d*. The cover 24 is joined to the case main body 23 from the other side in the vehicle fore-and-aft direction so as to oppose the end wall 23*e*.

A rectangular insertion hole 25 (see FIG. 1) is formed in the bottom wall 16*a* of the recess part 16, and the case 22 is inserted through the insertion hole 25 from the outside in the vehicle width direction. Moreover, a rectangular collar portion 23*f* is integrally and connectedly provided on the outer side wall 23*c* of the case main body 23 so as to protrude outward from the outer periphery thereof, and the case 22 is inserted through the insertion hole 25 from the outside in the vehicle width direction so as to make the collar portion 23*f* abut against an outer face of the bottom wall 16*a* at the peripheral edge part of the insertion hole 25. Furthermore, a base end part of a resilient claw 27 is connected to the upper side wall 23*a* and the lower side wall 23*b* of the case main body 23, the resilient claw 27 flexing when the case 22 is inserted into the insertion hole 25 so as to pass through the insertion hole 25, and the tip end part of the resilient claw 27 abuts against an inner face of the bottom wall 16*a*. That is, the bottom wall 16*a* is clamped between the collar portion 23*f* and the resilient claw 27, and the case 22 is thereby mounted on the bottom wall 16*a* of the vehicle body outer plate 15.

The lid opening and closing device 20 includes the rod 21, a restriction member 28 being capable of restricting movement of the rod 21, and an electric motor 29 driving the restriction member 28, the restriction member 28 and the electric motor 29 being housed within the case 22.

The rod 21 is disposed so as to extend in the vehicle width direction in an upper part of the case 22, and is movably supported on the case main body 23 of the case 22. A support rib 31 is integrally and projectingly provided on an inner face of the end wall 23*e* of the case main body 23 so as to extend in the longitudinal direction of the rod 21, the support rib 31 having at the protruding end a sliding contact support face 30 recessed in an arc shape so as to be in sliding contact with part of an outer peripheral face of the rod 21, which has a circular cross section. A through hole 32 is formed in an upper part of the outer side wall 23*c* of the case main body 23, the rod 21 being axially movably inserted through the through hole 32, a short cylindrical portion 23*g* protruding from the outer side wall 23*c* toward the recess part 16 side so as to form part of the through hole 32 is integrally and projectingly provided on the upper part of the outer side wall 23*c* of the case main body 23, and an annular outer seal member 33 is fitted onto the short cylindrical portion 23*g*, the outer seal member 33 being in resilient sliding contact with the outer periphery of the rod 21.

A holder 35 is axially relatively non-movably linked to the rod 21 within the case 22, and the holder 35 is relatively rotatably fitted onto the rod 21 so that it cannot move relative thereto in the axial direction.

Figure 7:
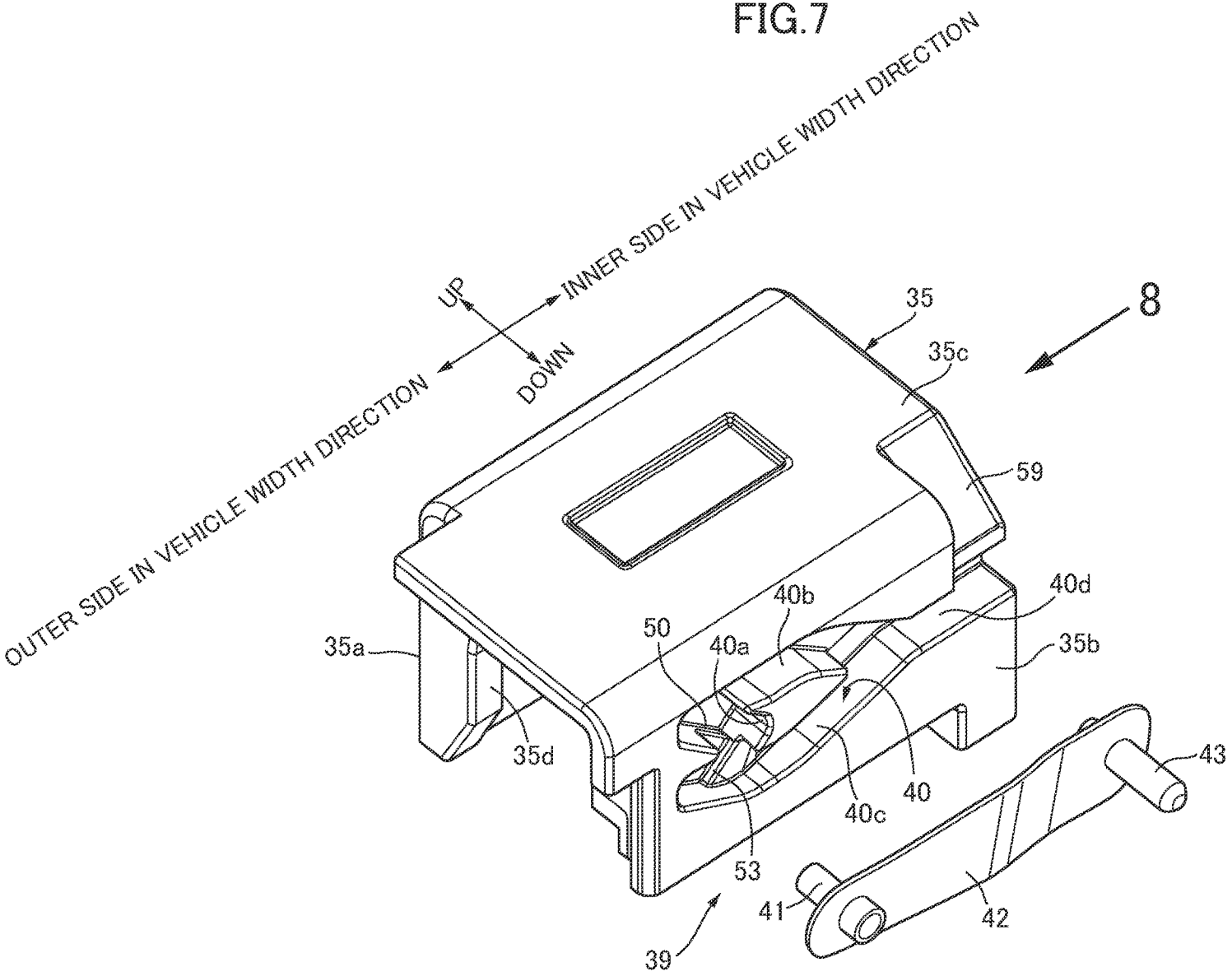
FIG. 7 is an exploded perspective view of a holder and an elastic member on which a pin is provided.
Figure 8:
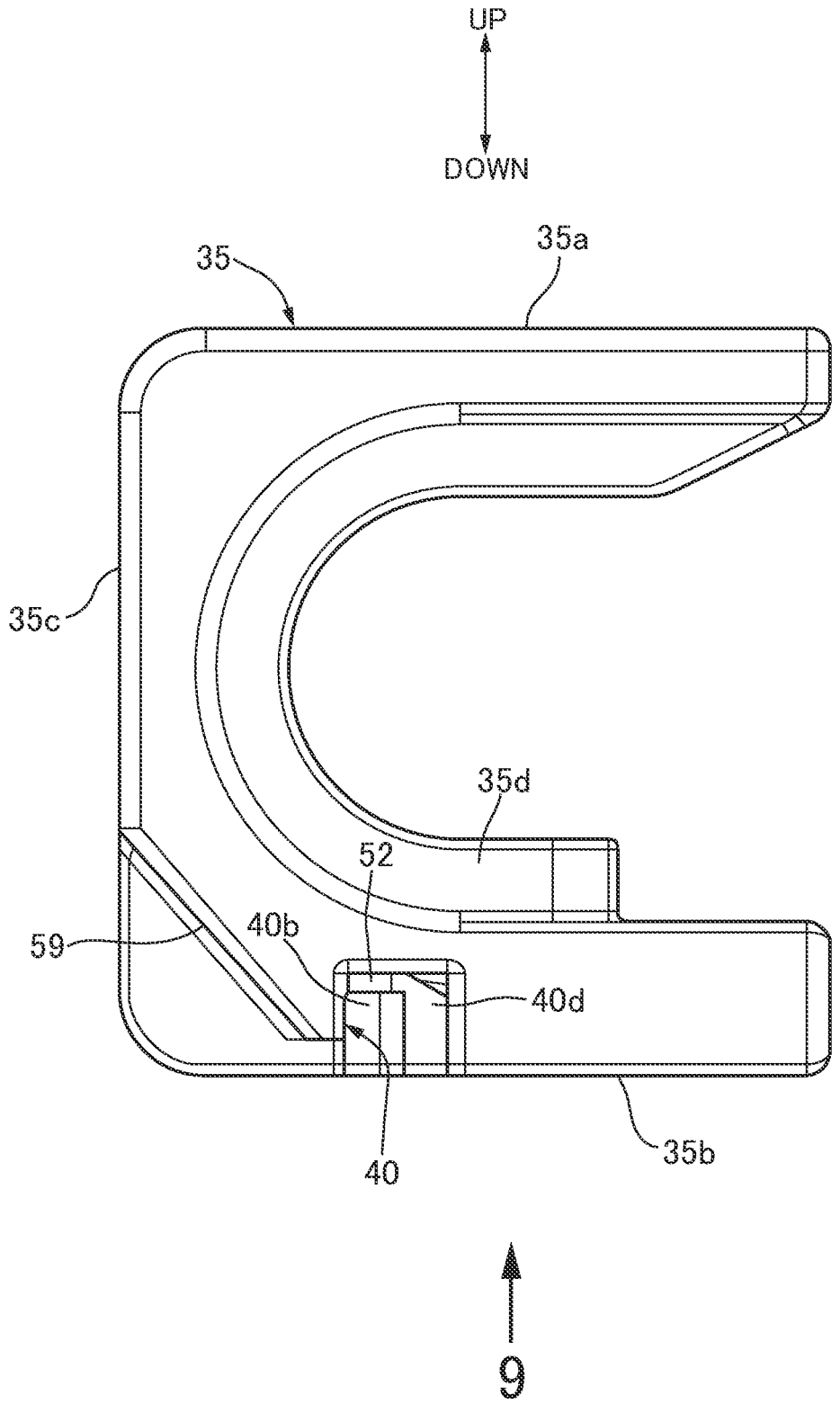
FIG. 8 is a view in the direction of arrow 8 in FIG. 7.
Figure 9:
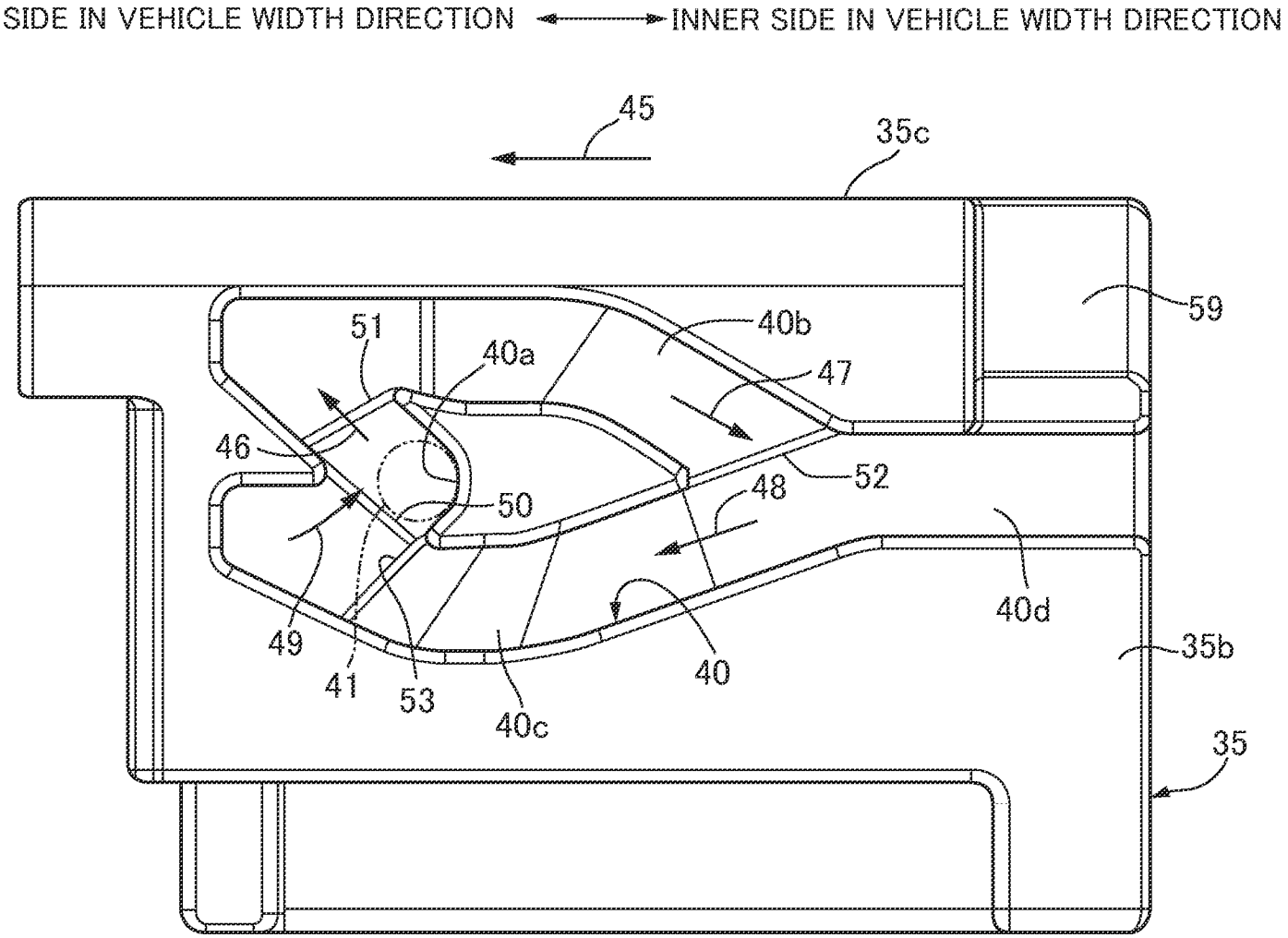
FIG. 9 is a view in the direction of arrow 9 in FIG. 8.

Referring in addition to FIG. 7 to FIG. 9, the holder 35 is formed so as to have a substantially U-shaped cross-sectional shape opening on the end wall 23*e* side while integrally having an upper wall portion 35*a* that is in sliding contact with an inner face of the upper side wall 23*a* of the case main body 23 of the case 22, a lower wall portion 35*b* disposed beneath the upper wall portion 35*a* in parallel therewith across a gap, and a vertical wall portion 35*c* providing a link between the upper wall portion 35*a* and the lower wall portion 35*b* while opposing the end wall 23*e* at a position spaced from the end wall 23*e* of the case main body 23.

An annular groove 36 is formed in the outer periphery of the rod 21 in a portion corresponding to the holder 35, and an engagement projection portion 35*d* that engages with the annular groove 36 is formed integrally with the holder 35. The holder 35 is thereby fitted onto the rod 21 so as to be capable of pivoting relative thereto within a restricted range around the axis of the rod 21 while being incapable of moving relative to the rod 21 in the axial direction.

A ring-shaped spring housing recess part 37 is formed in a part of the rod 21 that is close to the inner side wall 23*d* of the case main body 23 so as to be coaxial with the axis of the rod 21 and open on the outer side wall 23*c* side, and a coil spring 38 having part thereof housed within the spring housing recess part 37 is provided between the rod 21 and the inner side wall 23*d*. The rod 21 is urged in a direction in which the engagement portion 21*a* at the tip end part thereof protrudes from the vehicle body outer plate 15 by virtue of the resilient force of the coil spring 38, and an axial position restricting groove 40 is formed in the lower wall portion 35*b* of the holder 35 in order to restrict the position of the rod 21 in the axial direction, a pin 41 being inserted into the axial position restricting groove 40.

A plate spring 42 is disposed between the holder 35 and the electric motor 29 so as to extend lengthwise in the longitudinal direction of the rod 21, a shaft 43 inserted through a base end part of the plate spring 42 is clamped between the case main body 23 and the cover 24, and the plate spring 42 is supported on the case 22 via the shaft 43 so that it can pivot in a permitted range within the case 22.

The pin 41 is fixed close to a free end part of the plate spring 42, and a projection 44 that abuts against a part that is close to the base end part of the plate spring 42 from the side opposite to the rod 21 is projectingly provided on the case main body 23. The plate spring 42 thus exhibits a resilient force that makes the pin 41 abut against the holder 35.

The axial position of the rod 21 is restricted by means of a rod axial direction-restricting mechanism 39 formed from the plate spring 42 having the pin 41 and the axial position restricting groove 40 of the holder 35.

Figure 10:
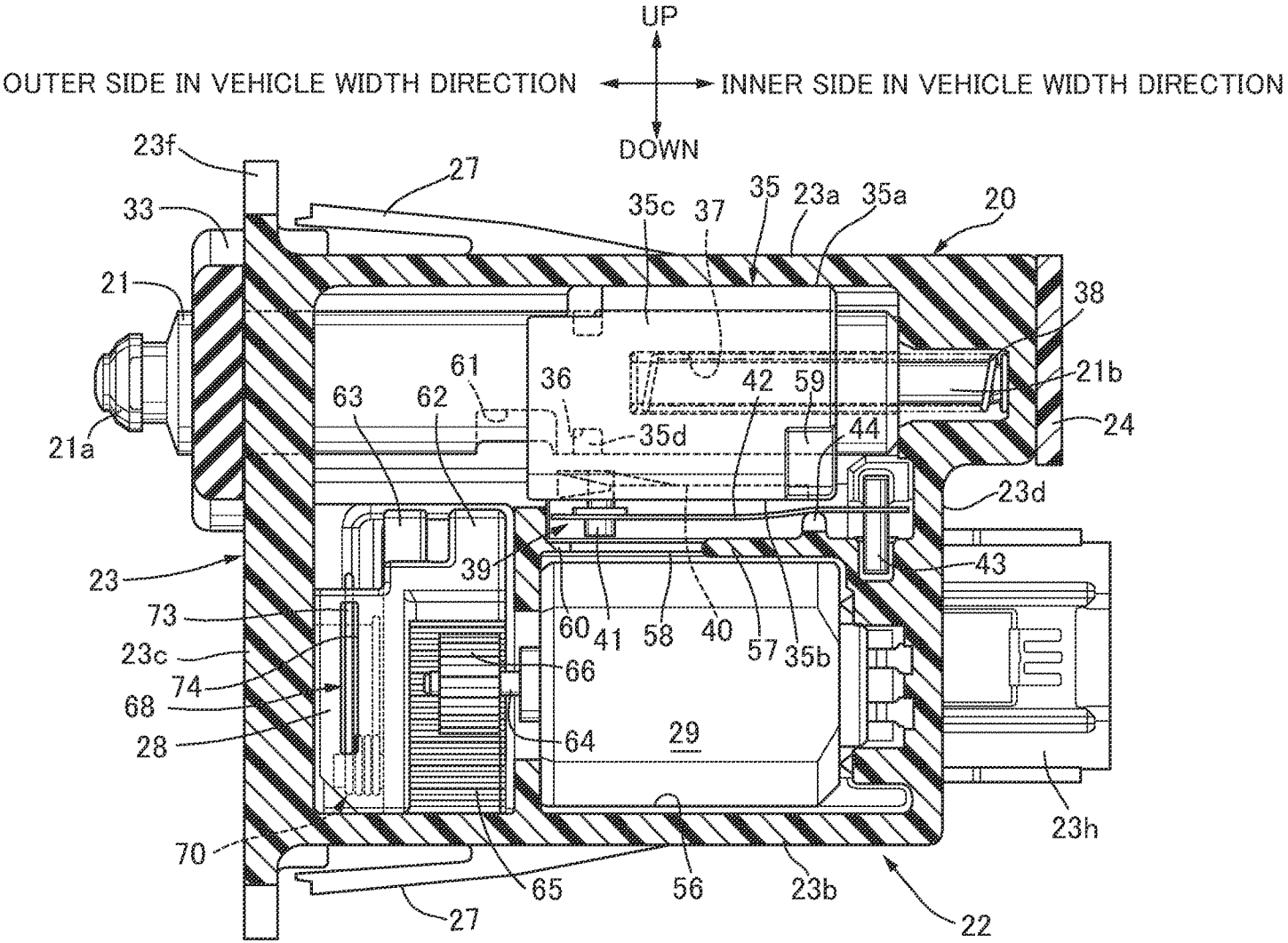
FIG. 10 is a sectional view, corresponding to FIG. 3, of the lid opening and closing device when the rod is at a pushed-in position.
Figure 11:
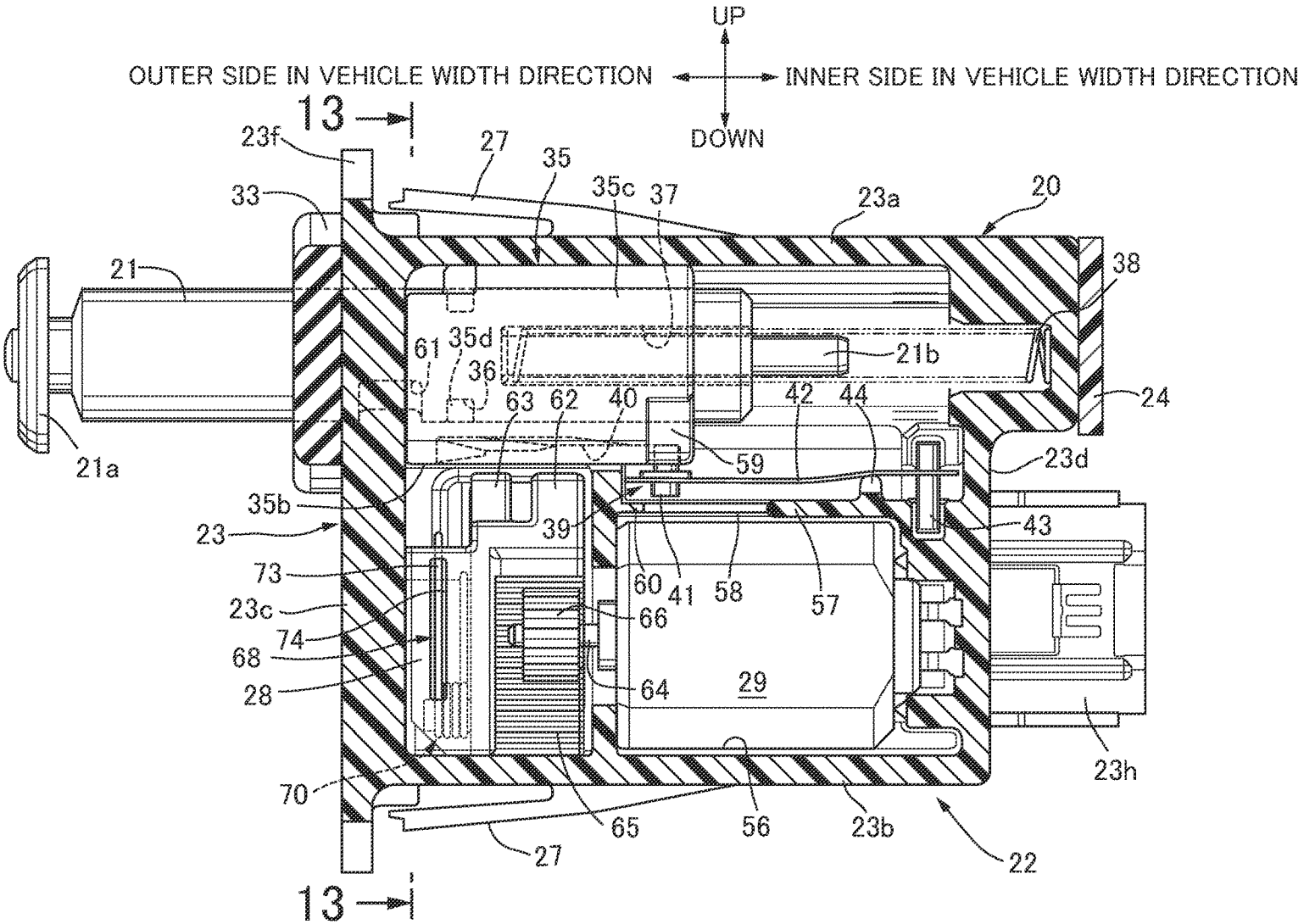
FIG. 11 is a sectional view, corresponding to FIG. 3, of the lid opening and closing device when the rod is at a protruding position.

The rod 21 can move back and forth between a pushed-in position in which as shown in FIG. 10 it is pushed in against the resilient force of the coil spring 38 in response to the lid 17 in a closed state and an open state being pushed in and a protruding position in which as shown in FIG. 11 it protrudes greatly from the case 22 due to the resilient force of the coil spring 38 when the lid 17 is in the open state; when the lid 17 is in the closed state the rod 21 is in a lid closed position as shown in FIG. 2, FIG. 3, FIG. 4, and FIG. 6 in which it is returned from the pushed-in position toward the protruding position side by a predetermined amount of movement.

A round rod-shaped stopper 21*b* is coaxially, integrally, and projectingly provided on an end part of the rod 21 on the inner side wall 23*d* side of the case main body 23, and as shown in FIG. 10 the stopper 21*b* abuts against the inner side wall 23*d* of the case main body 23 and restricts the end of movement of the rod 21 in the pushing-in direction when the rod 21 is in the pushed-in position. The holder 35 functions so as to restrict the protruding position of the rod 21, the holder 35 being mounted on the rod 21 so that, when the rod 21 is in the protruding position, as shown in FIG. 11 the holder 35 abuts against the outer side wall 23*c* of the case main body 23 and restricts the end of movement of the rod 21 in the protruding direction.

Referring to FIG. 9, the axial position restricting groove 40 is formed so as to have a pin-receiving portion 40*a*, first and second pushed-in position-receiving portions 40*b*, 40*c*, and a protruding position-receiving portion 40*d*. The pin-receiving portion 40*a* is formed while facing the protruding position side of the rod 21 so as to receive the holder 35, which is urged by the coil spring 38 together with the rod 21 in an urging direction shown by arrow 45, by means of the pin 41 when the rod 21 is in the lid closed position, and so as to abut against the pin 41 in a direction along the urging direction in order to prevent the rod 21 from moving up to the protruding position. The first and second pushed-in position-receiving portions 40*b*, 40*c* receive the pin 41 when the rod 21 and the holder 35 are in the pushed-in position. The protruding position-receiving portion 40*d* receives the pin 41 when the rod 21 and the holder 35 are in the protruding position.

When the lid 17 in the closed position is pushed in, the pin 41 is displaced from the pin-receiving portion 40*a* to the first pushed-in position-receiving portion 40*b* as shown by arrow 46 as a result of movement of the rod 21 and the holder 35 to the pushed-in position, and when the rod 21 and the holder 35 move to the protruding position in response to release of the force pushing the lid 17, the pin 41 is displaced from the first pushed-in position-receiving portion 40*b* to the protruding position-receiving portion 40*d* as shown by arrow 47. Pushing in the rod 21 together with the lid 17 when the lid 17 is in the open position moves the rod 21 and the holder 35 to the pushed-in position to thus displace the pin 41 to the second pushed-in position-receiving portion 40*c* as shown by arrow 48, and releasing the force pushing the lid 17 moves the rod 21 and the holder 35 to the lid closed position to thus displace the pin 41 from the second pushed-in position-receiving portion 40*c* to the pin-receiving portion 40*a* as shown by arrow 49 and make it abut against the pin-receiving portion 40*a*.

Formed in the axial position restricting groove 40 are a first step part 50, a second step part 51, a third step part 52, and a fourth step part 53. The first step part 50 prevents the pin 41 from being reversely displaced from the pin-receiving portion 40*a* to the second pushed-in position-receiving portion 40*c*, the second step part 51 prevents the pin 41 from being reversely displaced from the first pushed-in position-receiving portion 40*b* to the pin-receiving portion 40*a*, the third step part 52 prevents the pin 41 from being reversely displaced from the protruding position-receiving portion 40*d* to the first pushed-in position-receiving portion 40*b*, and the fourth step part 53 prevents the pin 41 from being reversely displaced from the second pushed-in position-receiving portion 40*c* to the protruding position-receiving portion 40*d*.

Formed on the holder 35 is a guide part 59 guiding the pin 41 of the plate spring 42 to the axial position restricting groove 40. The guide part 59 is formed on a lower part of an end part, on the inner side in the vehicle width direction, of the vertical wall portion 35*c* of the holder 35, and is formed into an inclined face that is inclined so as to be closer to the protruding position-receiving portion 40*d* of the axial position restricting groove 40 in going downward. The guide part 59 functions to guide the pin 21 when assembling the holder 35 on the case main body 23 side in a state in which the shaft 43 on the base end part of the plate spring 42 has been assembled on the case main body 23 of the case 22, the pin 21 being inserted into the protruding position-receiving portion 40*d* of the axial position restricting groove 40 by being guided by the guide part 59. This enables the pin 41 to be easily inserted into the axial position restricting groove 40 even in a state in which the plate spring 42 has been assembled on the case main body 23 of the case 22, thus enhancing the ease of assembly.

The engagement portion 21*a* at the tip end part of the rod 21 has a substantially T-shaped form, the engagement portion 21*a* engages with the latching part 18 when the lid 17 is in the closed position but the engagement with the latching part 18 is released when the lid 17 is opened, and by pivoting the rod 21 on its axis through 90 degrees it is possible to switch between engagement of the engagement portion 21*a* with the latching part 18 and disengagement therefrom.

Figure 6:
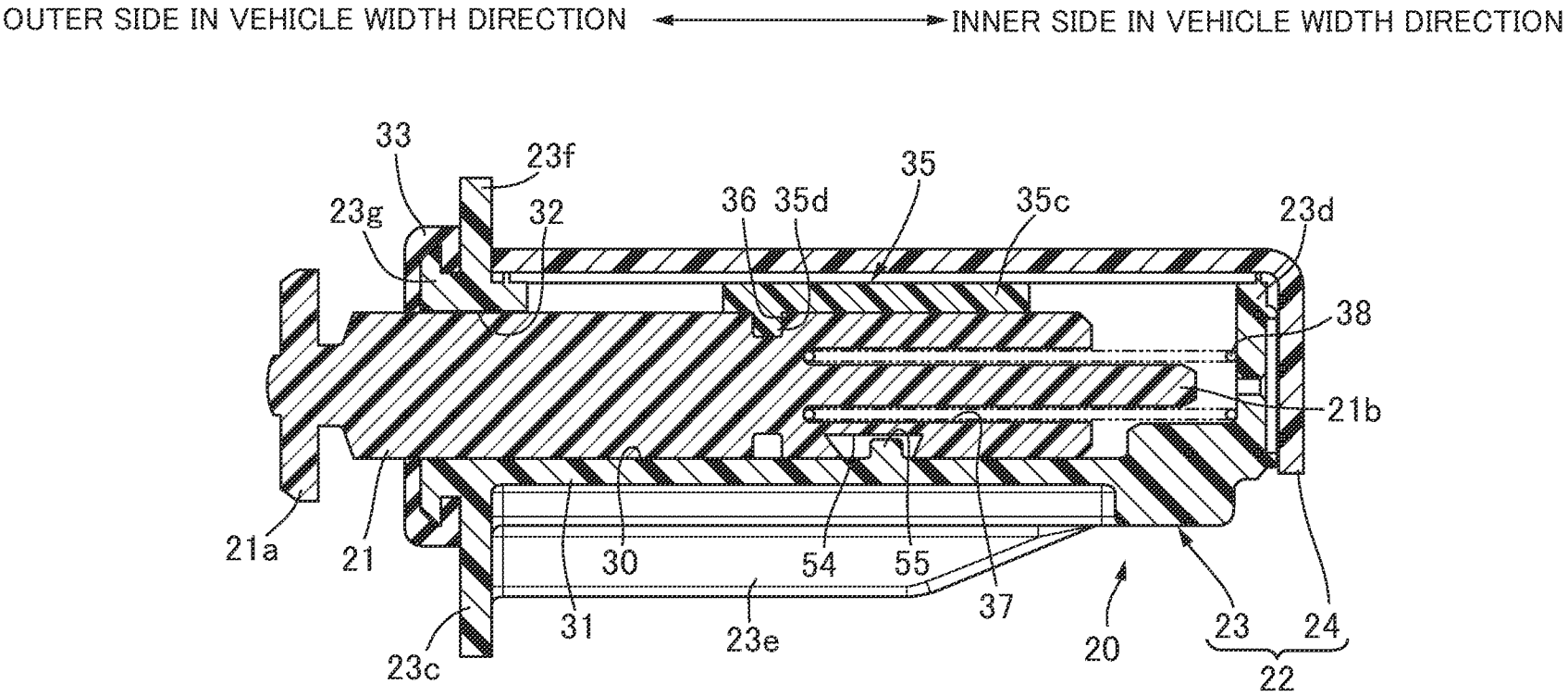
FIG. 6 is a sectional view along line 6-6 in FIG. 3.

Referring to FIG. 6, a helical guide groove 54 is formed in the outer periphery, facing the end wall 23*e* side of the case main body 23, of the rod 21, and a projection 55 that is made to project into the guide groove 54 is integrally and projectingly provided on the end wall 23*e* on the case main body 23. The guide groove 54 is formed so as to make the rod 21 spin on its axis through 90 degrees while the rod 21 moves in the axial direction between the pushed-in position and the protruding position.

The electric motor 29 has a rotational axis that is parallel to the axis of the rod 21, and is housed within the case 22 so as to be disposed close to the inner side wall 23*d* of the case main body 23 beneath the rod 21 and the holder 35. A substantially L-shaped dividing wall 57 is integrally and projectingly provided on the case main body 23 so as to form a motor housing recess part 56 housing the electric motor 29 in cooperation with the inner side wall 23*d* and the lower side wall 23*b*. Moreover, an opening 58 that can house part of the pin 41 fixed to the plate spring 42 is formed in the dividing wall 57. A connector portion 23*h* connected to the electric motor 29 is formed integrally with the inner side wall 23*d*.

Provided on the case 22 is a restriction part 60 that restricts displacement of the plate spring 42 from the axial position restricting groove 40 to the side on which the pin 41 is detached, and in this embodiment the restriction part 60 protruding into the opening 58 is provided integrally with the case main body 23 of the case 22 so that it can abut against the free end part of the plate spring 42 from the side opposite to the holder 35.

Figure 12:
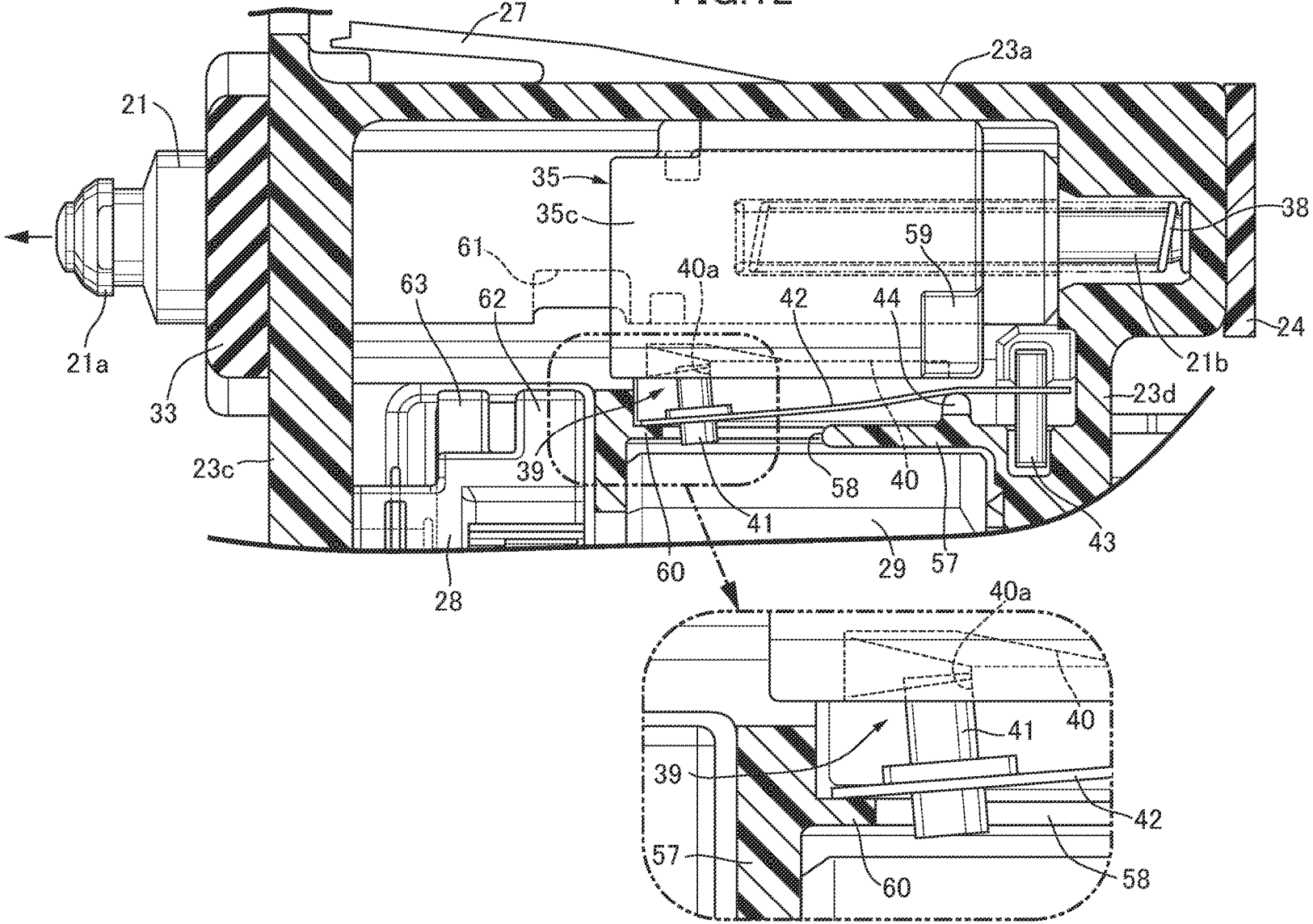
FIG. 12 is an enlarged view of an essential part of FIG. 3 showing a state when a force toward the opening side is forcibly applied to the lid at the closed position.

Therefore, even if a force to open the lid 17 in the closed position is forcibly applied thereto, due to the restriction part 60 abutting against the plate spring 42 as shown in FIG. 12 displacement of the plate spring 42 to the side on which the pin 41 is detached from the axial position restricting groove 40 is restricted, the pin 41 will not be detached from the axial position restricting groove 40, and it is thus possible to enhance the theft resistance.

Figure 3:
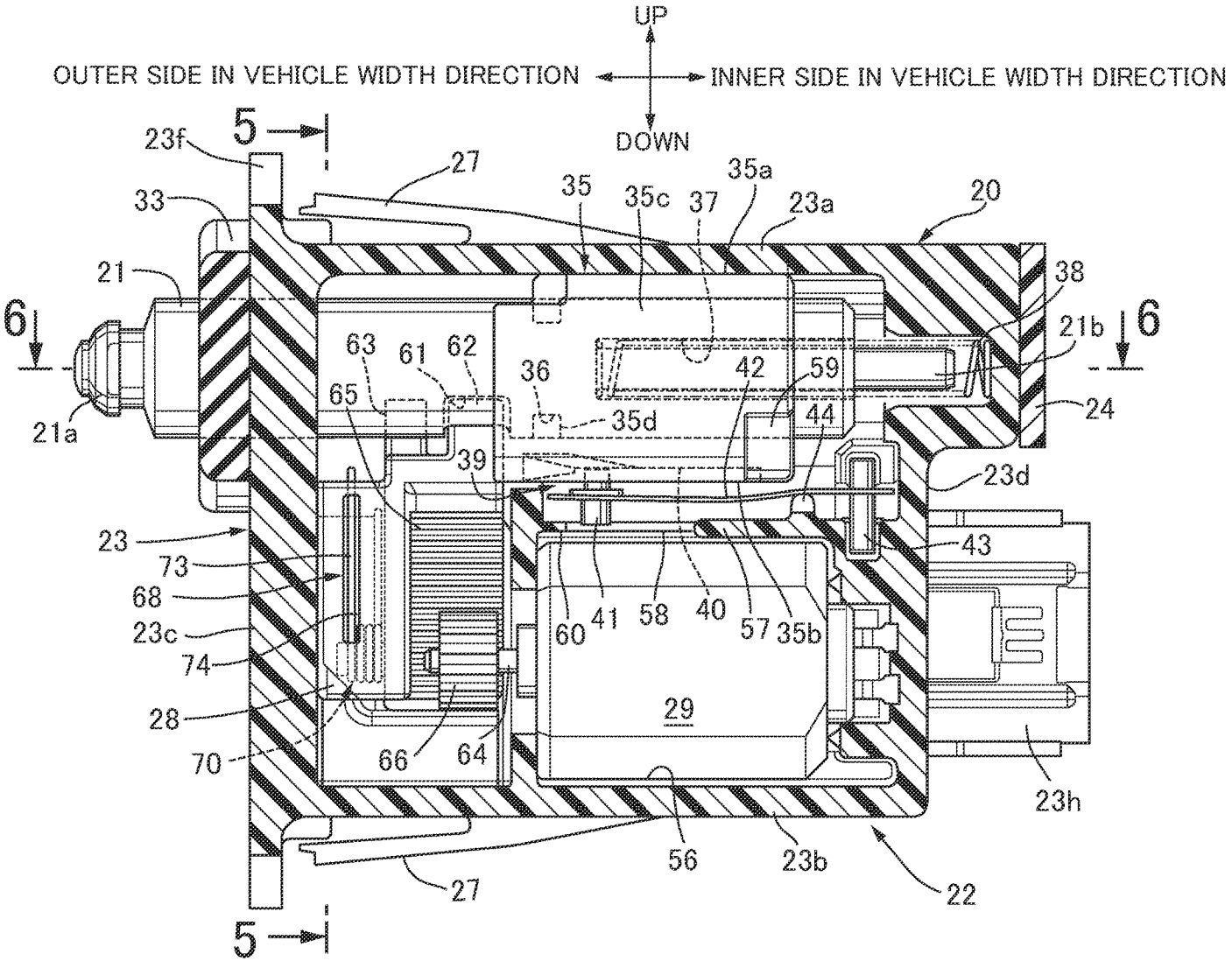
FIG. 3 is a sectional view along line 3-3 in FIG. 2 when a door is in a locked state.
Figure 4:
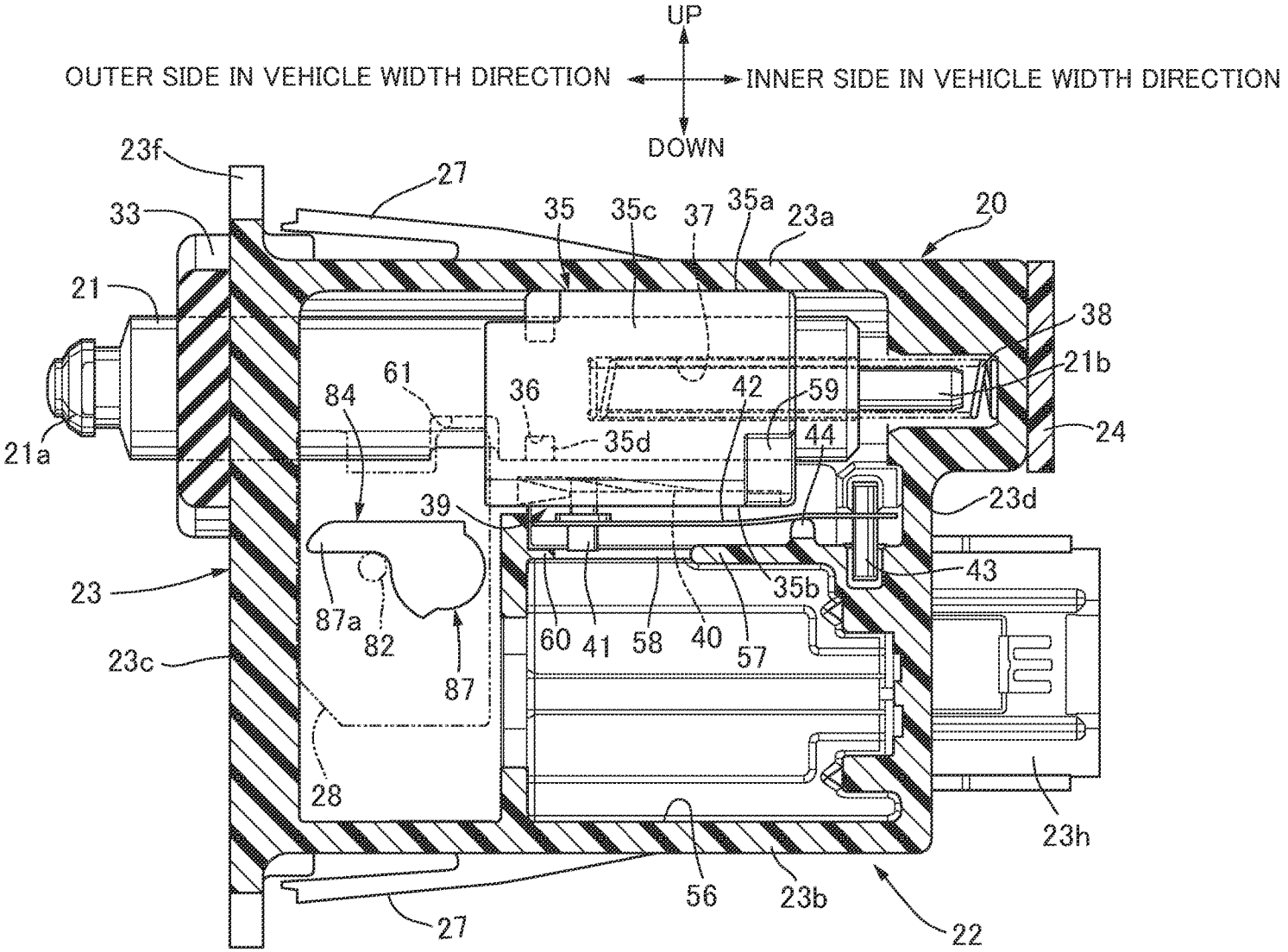
FIG. 4 is a sectional view corresponding to FIG. 3 when an electric motor and a restriction member are removed.
Figure 5:
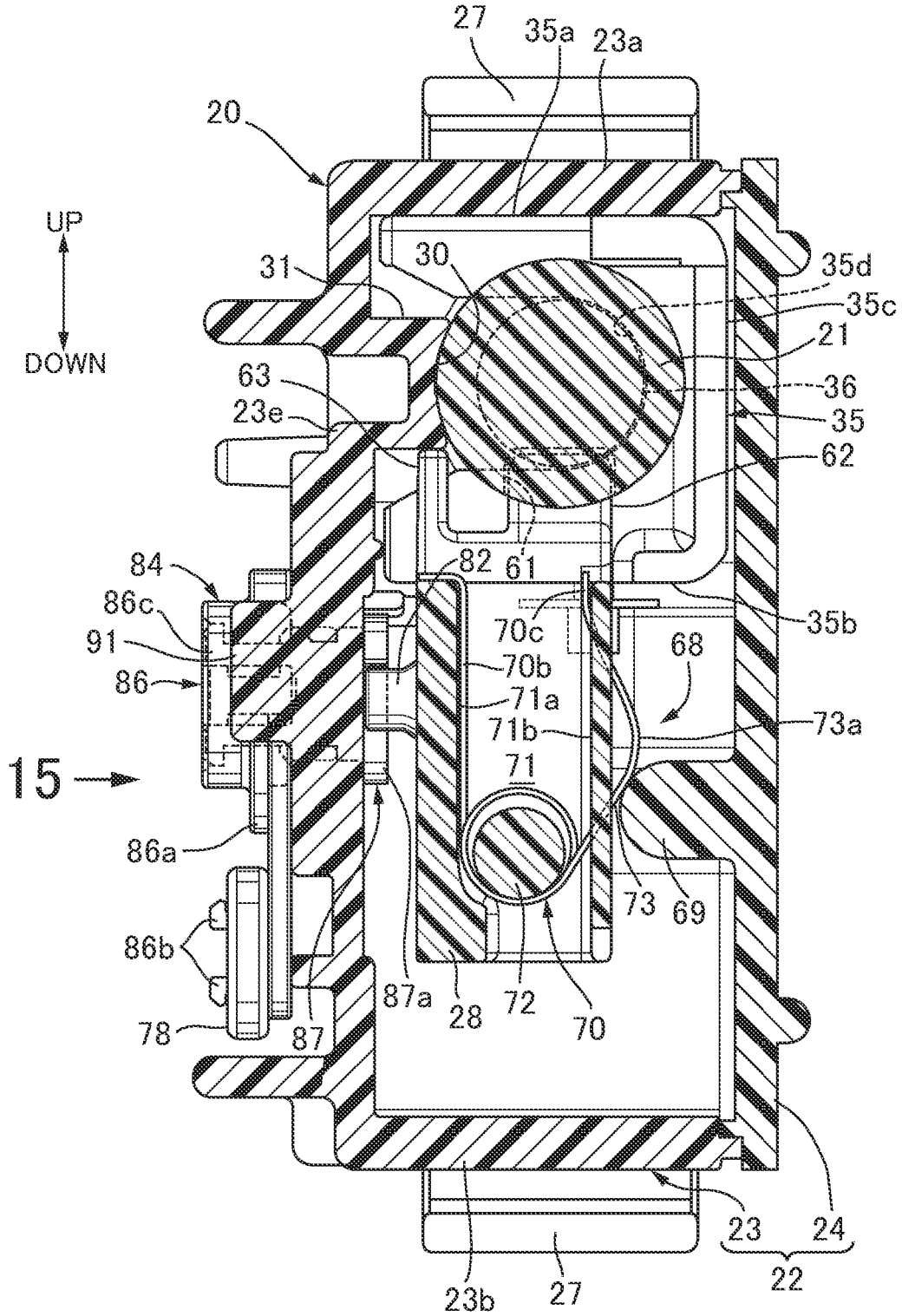
FIG. 5 is a sectional view along line 5-5 in FIG. 3.
Figure 13:
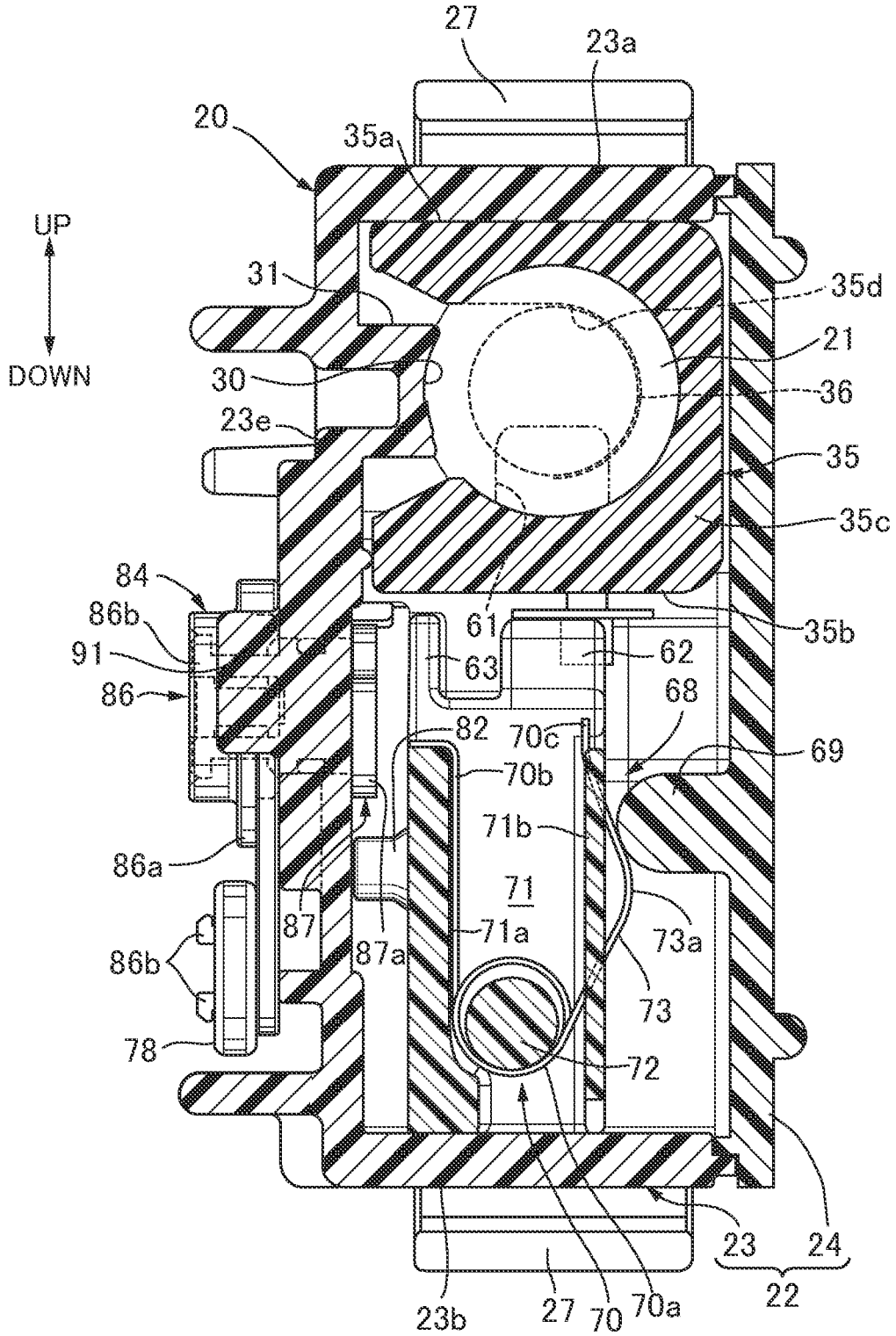
FIG. 13 is a sectional view along line 13-13 in FIG. 11.

The restriction member 28 is housed within the case 22 so as to be disposed beneath the rod 21 and the holder 35 further on the outside in the vehicle width direction than the electric motor 29, and the restriction member 28 is housed in the case 22 so that it can operate in a direction orthogonal to the back-and-forth movement direction of the rod 21, in this embodiment in the up-down direction, between a restriction position as shown in FIG. 3 and FIG. 5 in which it engages with the rod 21 in the lid closed position so as to restrict movement of the rod 21 and a restriction release position as shown in FIG. 10, FIG. 11, and FIG. 13 in which it moves away from the rod 21 by disengaging from the rod 21 and releases the restriction of the rod 21.

A latching recess part 61 that faces the restriction member 28 side when the rod 21 is in the lid closed position is formed in the outer periphery of the rod 21, and an engagement projection 62 that is fitted into and engaged with the latching recess part 61 when the rod 21 is in the lid closed position is projectingly provided on an end part, on the rod 21 side, of the restriction member 28. Furthermore, a stopper 63 is integrally and projectingly provided on the end part, on the rod 21 side, of the restriction member 28, the stopper 63 abutting against the support rib 31 projectingly provided on an inner face of the end wall 23*e* as shown in FIG. 5 when the restriction member 28 has moved to the restriction position in a state in which the rod 21 is in the lid closed position, thereby determining the restriction position for the restriction member 28.

An output shaft 64 of the electric motor 29 has an axis that is parallel to the rod 21, that is, orthogonal to the direction of operation of the restriction member 28, the output shaft 64 extending rotatably through the dividing wall 57 and protruding toward the restriction member 28 side. On the other hand, provided on the restriction member 28 is a rack 65 extending along the direction of movement thereof, a pinion 66 provided on the output shaft 64 meshing with the rack 65. The restriction member 28 is therefore driven so as to operate between the restriction position and the restriction release position by means of operation of the electric motor 29.

The electric motor 29 operates only for a predetermined time (e.g. 0.6 sec) in response to a vehicle door being switched between a locked state and an unlocked state by means of a smart entry system or a keyless button operation by a vehicle user; when the door is in the locked state the electric motor 29 drives the restriction member 28 to the restriction position, and when the door is in the unlocked state the electric motor 29 drives the restriction member 28 to the restriction release position.

In a state in which the rod 21 is in the protruding position, that is, in a state in which the lid 17 is open, if a vehicle user erroneously puts the door into the locked state, although the restriction member 28 in the restriction release position is driven to the restriction position side by means of the electric motor 29, the restriction member 28 cannot engage with the rod 21 in the protruding position, as shown in FIG. 13 the engagement projection 62 and the stopper 63 of the restriction member 28 abut against the holder 35 before reaching the restriction position, and movement of the restriction member 28 to the restriction position is thus prevented. Because of this, there is a possibility that when operation of the electric motor 29 is stopped, the restriction member 28 will stop at a halfway position before reaching the restriction position, but due to the function of a holding mechanism 68 the restriction member 28 is returned to the restriction release position.

The holding mechanism 68 resiliently holds at least the restriction release position of the restriction member 28, and is formed from an abutment part 69 provided integrally with the cover 24 forming part of the case 22, and an elastic member 70 mounted on the restriction member 28 while abutting against the abutment part 69 so as to urge the restriction member 28 toward the restriction release position side when the restriction member 28 is at a position partway along moving from the restriction release position toward the restriction position side.

A groove 71 opening on the outer side wall 23*c* side of the case main body 23 is formed in the restriction member 28 throughout the entire length in the direction of movement of the restriction member 28, and a support shaft 72 disposed within the groove 71 is integrally and projectingly provided on the restriction member 28. The elastic member 70 has a coil portion 70*a* surrounding the support shaft 72, and first and second arm portions 70*b*, 70*c* extending from opposite ends of the coil portion 70*a*.

The first arm portion 70*b* of the elastic member 70 is abutted against and supported on, among side walls 71*a*, 71*b* on opposite sides of the groove 71, the side wall 71*a* further from the cover 24. The tip end part of the second arm portion 70*c* is abutted against and supported on, among the side walls 71*a*, 71*b* on opposite sides of the groove 71, the side wall 71*b* on the cover 24 side, and a chevron-shaped resilient portion 73 curving so as to bulge toward the cover 24 side is formed in an intermediate part of the second arm portion 70*c*. A slit 74 through which the resilient portion 73 is inserted is provided in the restriction member 28, the resilient portion 73 protruding toward the cover 24 side via the slit 74.

Figure 14:
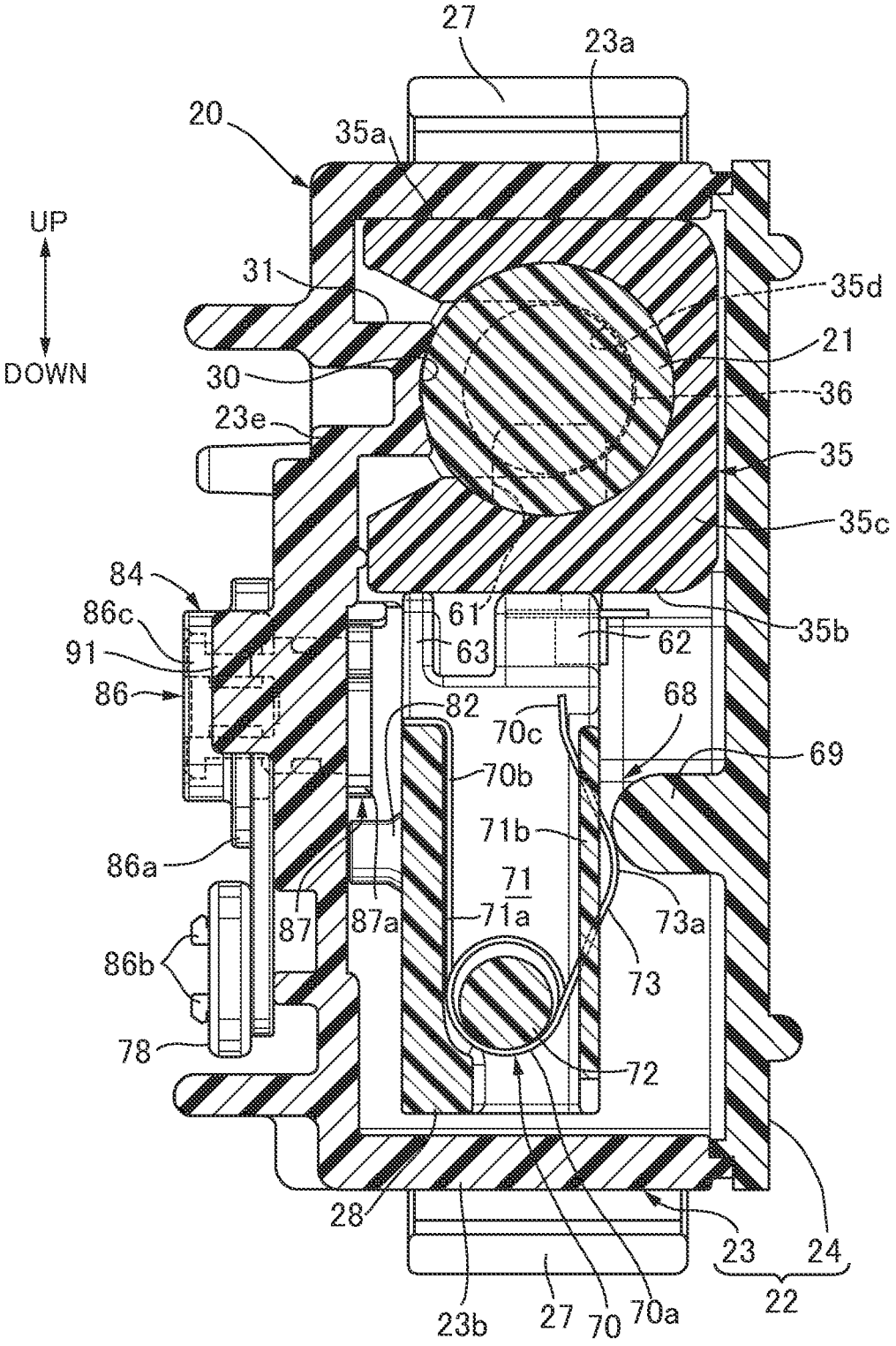
FIG. 14 is a sectional view corresponding to FIG. 13 when the door is in a locked state while the rod is at the protruding position.

On the other hand, the abutment part 69 projectingly provided on the cover 24 always abuts against the resilient portion 73, as shown in FIG. 13 the resilient portion 73 abuts against the abutment part 69 further on the tip end part side of the second arm portion 70*c* than a chevron-shaped apex portion 73*a* in a state in which the restriction member 28 is in the restriction release position, and the resilient portion 73 exhibits a resilient force that urges the restriction member 28 toward the restriction release position side. In a state in which the restriction member 28 is in the restriction position, as shown in FIG. 5 the resilient portion 73 abuts against the abutment part 69 further on the side opposite to the tip end part of the second arm portion 70*c* than the chevron-shaped apex portion 73*a*, and the resilient portion 73 exhibits a resilient force that urges the restriction member 28 toward the restriction position side. Furthermore, when the restriction member 28 is at an intermediate position between the restriction position and the restriction release position as shown in FIG. 14, the abutment part 69 will not ride over the apex portion 73*a* of the resilient portion 73, the resilient portion 73 abuts against the abutment part 69 further on the tip end part side of the second arm portion 70*c* than the apex portion 73*a*, and the resilient portion 73 exhibits a resilient force that urges the restriction member 28 toward the restriction release position side. When the restriction member 28 is driven toward the restriction position side by means of the electric motor 29 and the restriction member 28 is at a halfway position before reaching the restriction position, the restriction member 28 is thereby returned to the restriction release position by the function of the holding mechanism 68 accompanying termination of operation of the electric motor 29.

When the electric motor 29 malfunctions, for example, when the electric motor 29 itself has broken down or operation of the electric motor 29 becomes impossible due to the connector portion 23*h* of the lid opening and closing device 20 breaking down, the lid 17 cannot be opened unless the restriction member 28 restricting the rod 21 in the door closed state is manually returned to the restriction release position. An emergency operation wire 76 as an emergency operation member that can move the restriction member 28 to the restriction release position when the electric motor 29 malfunctions is therefore disposed so as to movably extend through a vehicle body inner plate 75 (see FIG. 1) disposed further on the inside than the vehicle body outer plate 15, and the emergency operation wire 76 can be manually pulled further inside the vehicle than the vehicle body inner plate 75.

Figure 15:
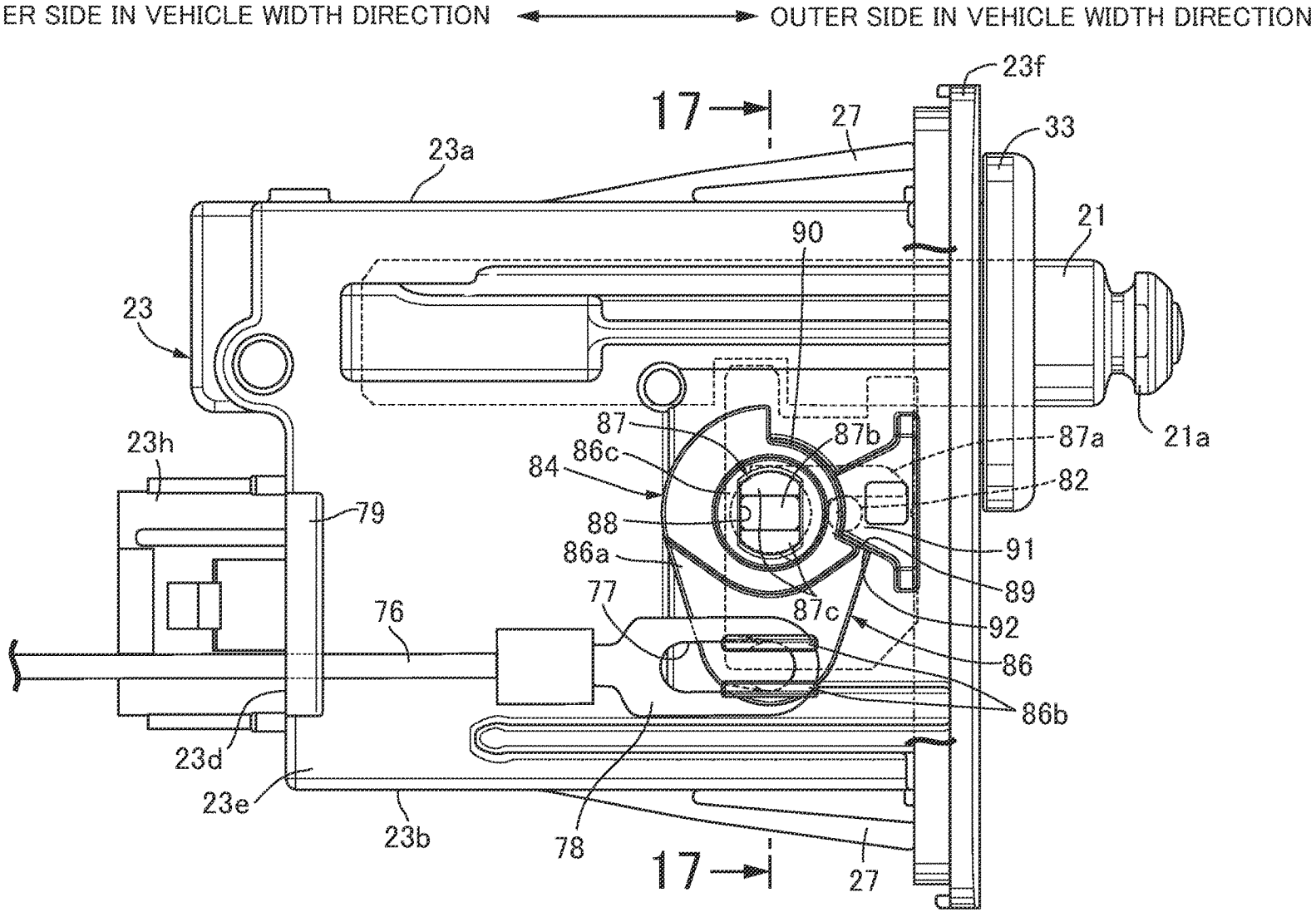
FIG. 15 is a view in the direction of arrow 15 in FIG. 5.
Figure 16:
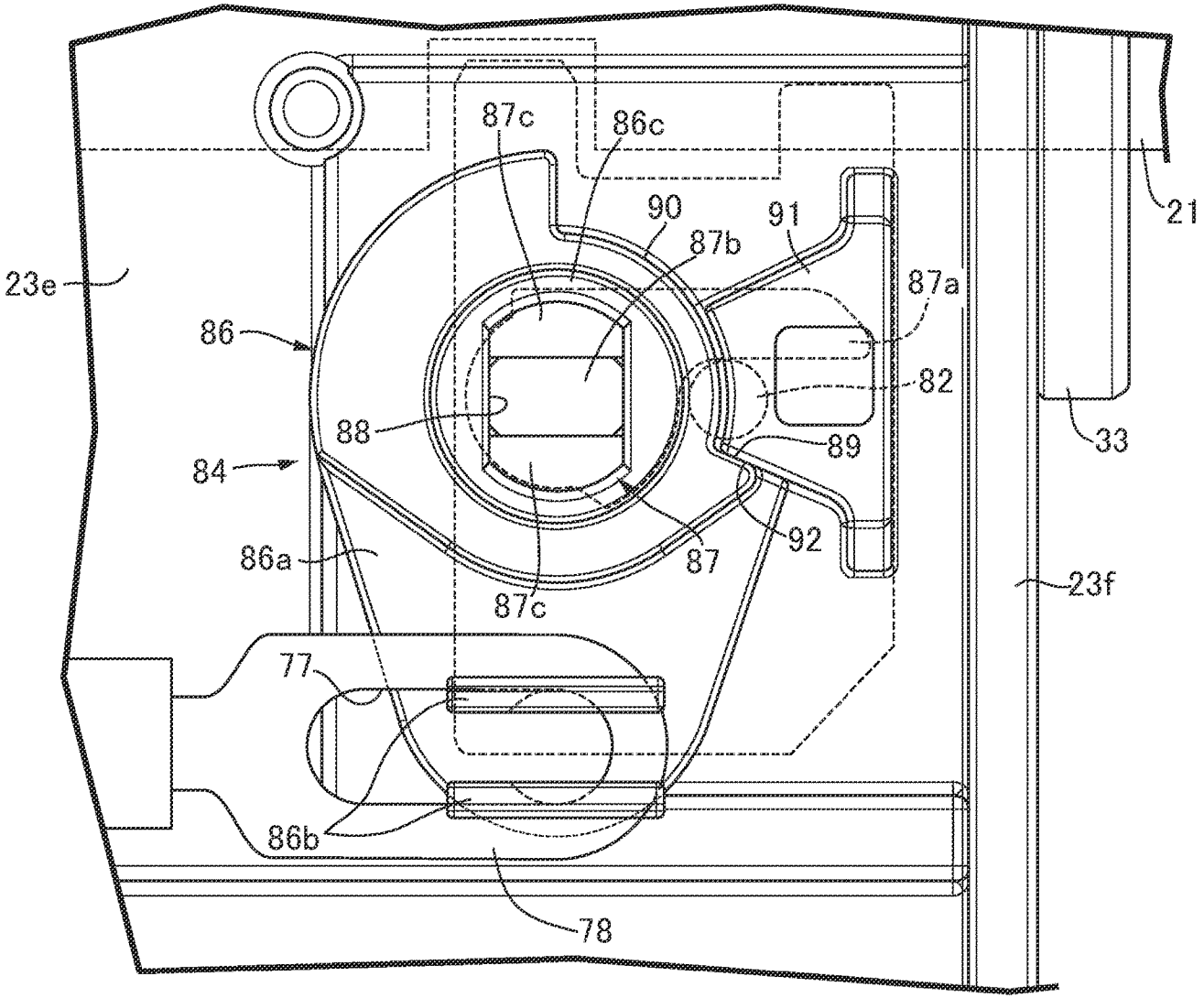
FIG. 16 is an enlarged view of an essential part of FIG. 15.

In FIG. 15 and FIG. 16, the emergency operation wire 76 can move along an outer face of the end wall 23*e* of the case main body 23 of the case 22, and a linking member 78 having an elongated hole-shaped first linking hole 77 is provided on an end part, on the lid opening and closing device 20 side, of the emergency operation wire 76. Furthermore, integrally and projectingly provided on the outer face of the end wall 23*e* is a guide projection 79 forming in cooperation with the end wall 23*e* a guide hole 80 (see FIG. 1) through which the emergency operation wire 76 is movably inserted.

Figure 17:
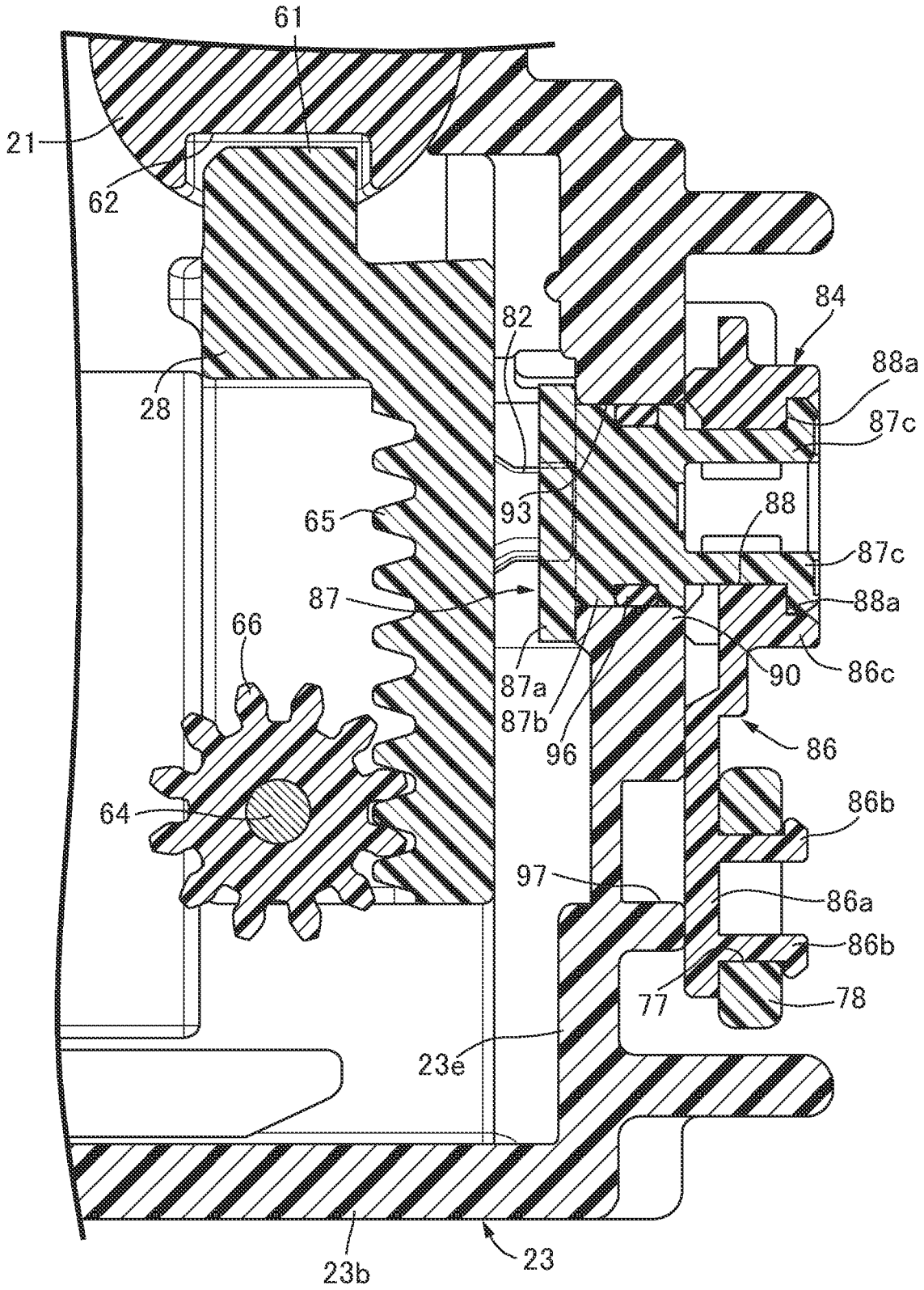
FIG. 17 is a sectional view along line 17-17 in FIG. 15.

Referring in addition to FIG. 17, an operating force-acting direction conversion mechanism 84 is provided between the restriction member 28 and the linking member 78; when the emergency operation wire 76 is pulled, the operating force-acting direction conversion mechanism 84 converts an operating force from the emergency operation wire 76 into a force that makes the restriction member 28 operate in a direction orthogonal to back-and-forth movement of the rod 21 from the restriction position toward the restriction release position.

The operating force-acting direction conversion mechanism 84 is formed from a pressure-receiving projection 82 integrally and projectingly provided on the restriction member 28, a first link member 86 pivoting in response to movement of the emergency operation wire 76, and a second link member 87 having its tip end part abutting against the pressure-receiving projection 82 from the restriction position side and pivoting so as to push the restriction member 28 toward the restriction release position in response to pivoting of the first link member 86. The pressure-receiving projection 82 is integrally and projectingly provided on the restriction member 28 so as to make its tip end part be close to and oppose an inner face of the end wall 23*e*.

Figure 18:
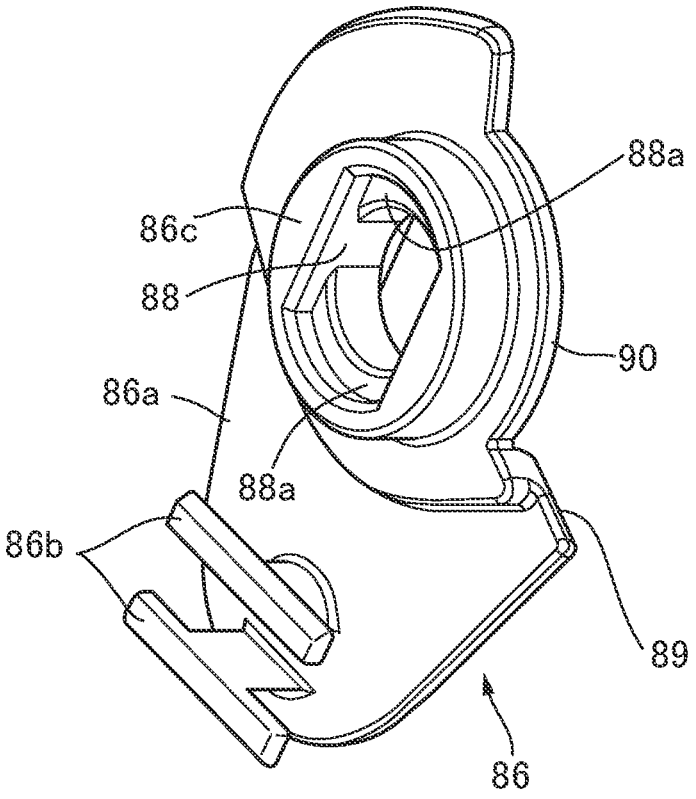
FIG. 18 is a perspective view of a first link member.

Referring in addition to FIG. 18, the first link member 86 is formed so as to integrally have a first link member main portion 86*a* disposed along the outer face of the end wall 23*e* of the case main body 23 of the case 22, a pair of first resilient engagement claws 86*b* integrally and projectingly provided on a side, opposite to the end wall 23*e*, of one end part of the first link member main portion 86*a* so as to be inserted through the first linking hole 77 of the linking member 78 of the emergency operation wire 76 and thus be pivotably and resiliently engaged with the linking portion 76*a*, and a linking tube portion 86*c* provided integrally with the other end part of the first link member main portion 86*a*.

Formed in the linking tube portion 86*c* is a second linking hole 88 having a rectangular cross section, and formed on mutually opposing side faces of an end part, on the side opposite to the end wall 23*e*, of the second linking hole 88 are latching step portions 88*a*.

A cutout 90 having a pivoting restriction face 89 at one end in the peripheral direction is formed in part of the outer periphery of the first link member main portion 86*a* around the linking tube portion 86*c*. On the other hand, a stopper 91 disposed within the cutout 90 is projectingly provided on the end wall 23*e* of the case main body 23, and a stopper face 92 that can abut against the pivoting restriction face 89 is formed on the stopper 91.

The second link member 87 is formed so as to integrally have a second link member main portion 87*a* disposed along the inner face of the end wall 23*e* of the case main body 23 of the case 22 so that its tip end part can abut against the pressure-receiving projection 82 from the restriction position side, a shaft portion 87*b* integrally connected to a base end part of the second link member main portion 87*a* so as to be pivotably fitted into a support hole 93 formed in the end wall 23*e*, and a pair of second resilient engagement claws 87*c* integrally and connectedly provided on the other end part of the shaft portion 87*b* on the outer side of the end wall 23*e*. An annular seal member 96 that is in resilient contact with an inner face of the support hole 93 is fitted onto the outer periphery of the shaft portion 87*b*.

The second resilient engagement claw 87*c* is inserted into the second linking hole 88 of the first link member 86 while flexing, and is resiliently engaged with the latching step portion 88*a*. The second link member 87 is thereby non-pivotably linked to the first link member 86.

In accordance with the operating force-acting direction conversion mechanism 84 having such an arrangement, when the restriction member 28 is at the restriction position and the emergency operation wire 76 is at the initial position, as shown in FIG. 15 and FIG. 16 the first link member 86 is in a state in which the pivoting restriction face 89 abuts against the stopper face 92 of the stopper 91 and pivoting thereof is restricted, and the tip end part of the second link member main portion 87*a* of the second link member 87 is stationary in a state in which it is close to the pressure-receiving projection 82 of the restriction member 28 from the restriction position side.

When the restriction member 28 is moved from the restriction position toward the restriction release position side by means of operation of the electric motor 29, the second link member 87 remains stationary without following the pressure-receiving projection 82 and pivoting.

Figure 19:
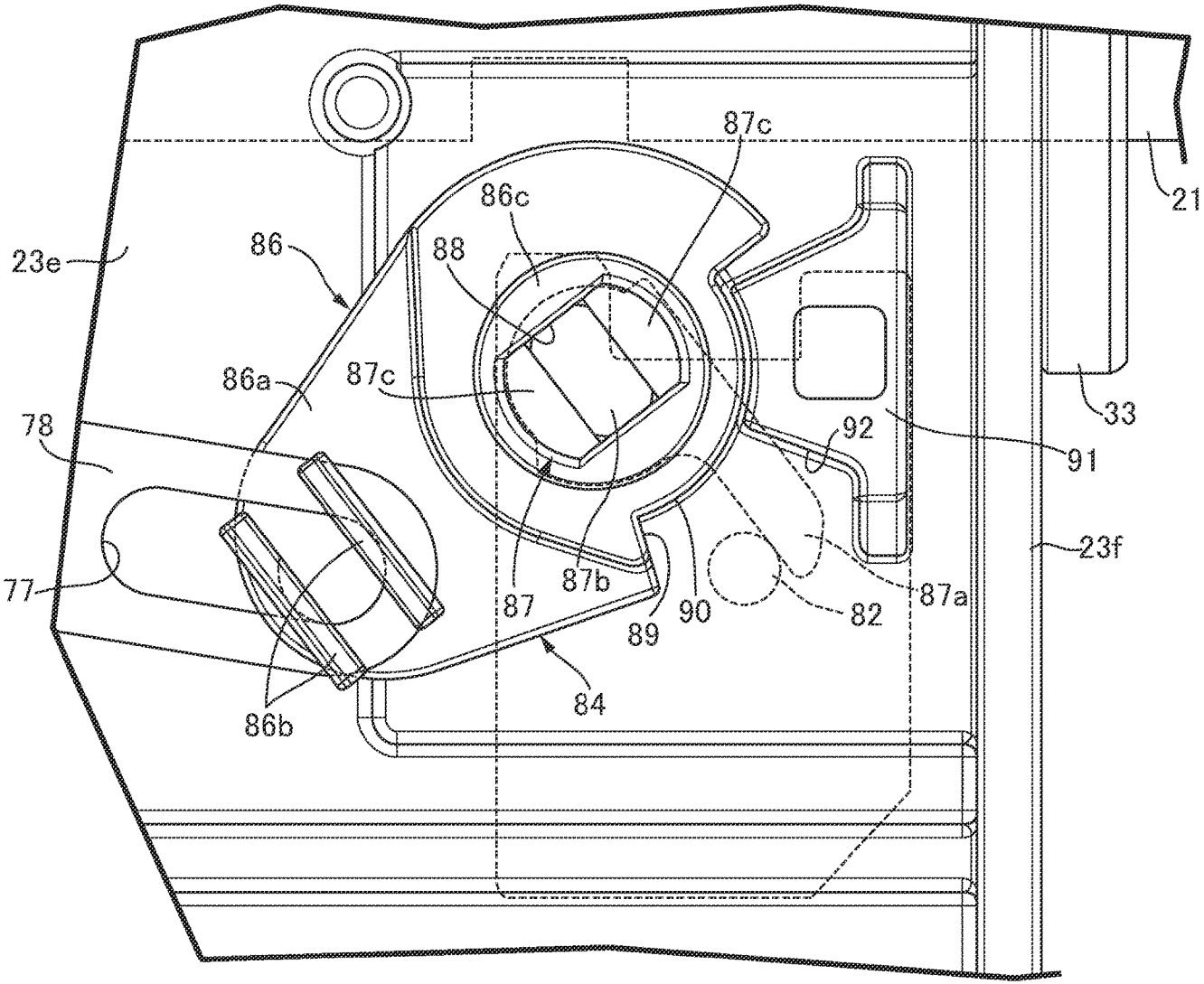
FIG. 19 is a view, corresponding to FIG. 15, when an emergency operation wire is in an operating state.

When the emergency operation wire 76 is pulled in a state in which the restriction member 28 is at the restriction position, as shown in FIG. 19 the first and second link members 86, 87 pivot, the pressure-receiving projection 82 is pushed in by means of the tip end part of the second link member main portion 87*a*, and the restriction member 28 moves to the restriction release position. In this arrangement, the end part, on the side opposite to the pivoting restriction face 89 in the peripheral direction, of the cutout 90 of the first link member 86 does not abut against the stopper 91, and the stopper 91 does not restrict pivoting of the first link member 86.

Figure 20:
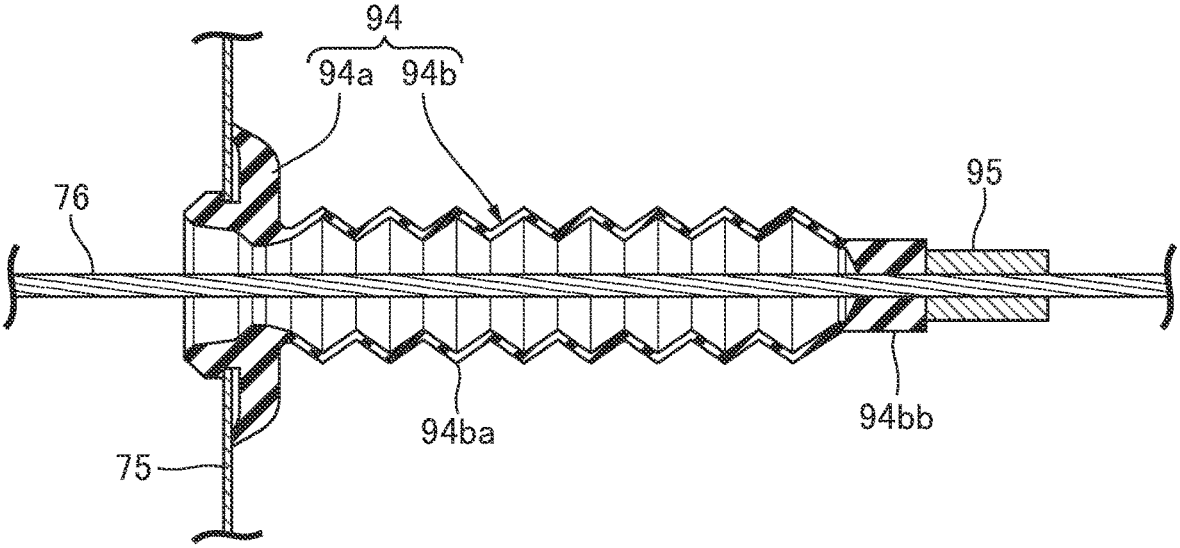
FIG. 20 is a sectional view showing a state in which the emergency operation wire is inserted through a grommet attached to a vehicle body inner plate.

Referring in addition to FIG. 20, a grommet 94 is provided between the vehicle body inner plate 75 and the emergency operation wire 76 extending movably through the vehicle body inner plate 75, the grommet 94 being capable of preventing water from entering between the vehicle body outer plate 15 and the vehicle body inner plate 75. The emergency operation wire 76 is resiliently urged toward the initial position side at least in the operating state (in this embodiment the operating state).

The grommet 94 is formed from an elastic material such as a rubber while being formed from a grommet main portion 94*a* liquid-tightly mounted on the vehicle body inner plate 75 and having the emergency operation wire 76 movably inserted therethrough, and an elastic portion 94*b* integrally connected to the grommet main portion 94*a* so that the emergency operation wire 76 can be resiliently urged toward the initial position side.

The elastic portion 94*b* is formed so as to integrally have a bellows portion 94*ba* formed into a bellows shape covering part of the emergency operation wire 76 and having one end part thereof integrally connected to the grommet main portion 94*a*, and a cylindrical press fit tube portion 94*bb* formed on the other end part of the bellows portion 94*ba* and having the emergency operation wire 76 press fitted therein into.

Moreover, a nipple 95 is fixed to the emergency operation wire 76, the nipple 95 moving close to or abutting against the press fit tube portion 94*bb* of the elastic portion 94*b* from the side opposite to the vehicle body inner plate 75 when the elastic portion 94*b* is in a natural state. The nipple 95 exhibits a function of preventing offsetting of the grommet 94 along the longitudinal direction of the emergency operation wire 76.

Figure 21C:
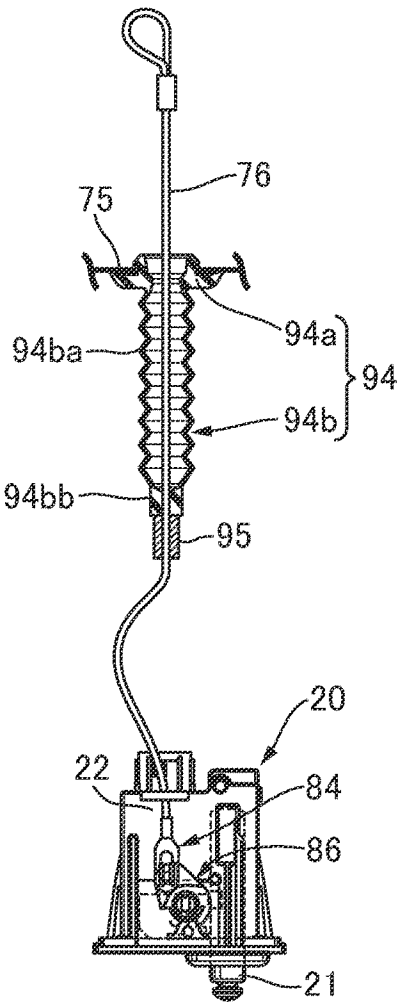
FIGS. 21A to 21C are views showing the lid opening and closing device in sequence according to the operation process of the emergency operation wire when viewed from the same direction as in FIG. 15.
Figure 21B:
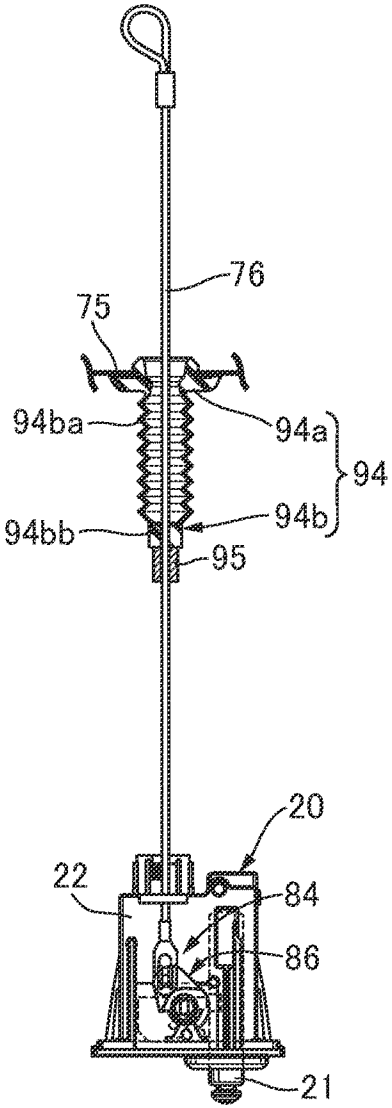
Figure 21A:
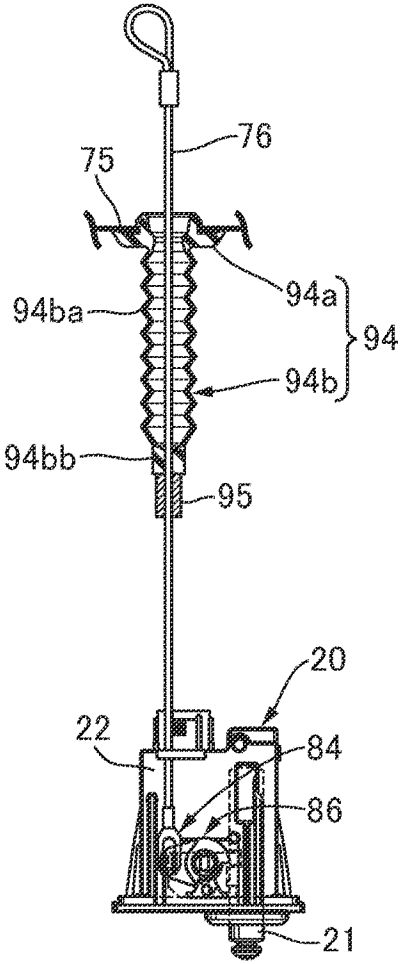

In FIGS. 21A, 21B, and 21C, when moving the restriction member 28 to the restriction release position when the electric motor 29 malfunctions, the emergency operation wire 76 may be pulled in a state in which the emergency operation wire 76 is at the initial position as shown in FIG. 21A, the emergency operation wire 76 thereby moves so as to pivot the first link member 86 of the operating force-acting direction conversion mechanism 84 as shown in FIG. 21B, and the bellows portion 94*ba* is compressed between the grommet main portion 94*a* mounted on the vehicle body inner plate 75 and the press fit tube portion 94*bb* fixed to the emergency operation wire 76. The emergency operation wire 76 is urged toward the initial position side by means of the resilient force exhibited by the bellows portion 94*ba* of the elastic portion 94*b* thus compressed when the emergency operation wire 76 is in the operating state. When the pulling force imposed on the emergency operation wire 76 is released after the restriction member 28 could be returned to the restriction release position when the electric motor 29 malfunctions by pulling the emergency operation wire 76, as shown in FIG. 21C the bellows portion 94*ba* so compressed expands and the nipple 95 returns to the original position. In this arrangement, deflection occurs in the emergency operation wire between the nipple 95 and the first link member, but the deflection is resolved by operation of the electric motor 29 accompanying malfunctioning of the electric motor 29 being resolved.

The operation of the embodiment is now explained; the emergency operation wire 76 extends movably though the vehicle body inner plate 75 while enabling the restriction member 28 to move to the restriction release position when the electric motor malfunctions, and is resiliently urged toward the initial position side in the operating state, and since the grommet 94 provided between the vehicle body inner plate 75 and the emergency operation wire 76 is formed from the grommet main portion 94*a* liquid-tightly mounted on the vehicle body inner plate 75 while enabling the emergency operation wire 76 to be movably inserted therethrough, and the elastic portion 94*b* integrally connected to the grommet main portion 94*a* while enabling the emergency operation wire 76 to be resiliently urged toward the initial position side, it becomes unnecessary to prepare an elastic member other than the grommet 94, thus reducing the number of components, and it is also unnecessary to assemble an elastic member within the case 22, thus reducing the number of assembly steps.

Furthermore, since the elastic portion 94*b* integrally has the bellows portion 94*ba* formed into a bellows shape covering part of the emergency operation wire 76 and having one end part thereof integrally connected to the grommet main portion 94*a*, and the cylindrical press fit tube portion 94*bb* formed on the other end part of the bellows portion 94*ba* and having the emergency operation wire 76 press fitted thereinto, due to the grommet main portion 94*a* being liquid-tightly mounted on the vehicle body inner plate 75 a seal is provided between the grommet 94 and the vehicle body inner plate 75, and due to the emergency operation wire 76 being press fitted into the elastic portion 94*b* covering the emergency operation wire 76, the grommet 94 is fixed to the emergency operation wire 76, and a seal is provided between the emergency operation wire 76 and the grommet 94, thus enabling reliable waterproofness to be obtained.

An embodiment of the present invention is explained above, but the present invention is not limited to the above-mentioned embodiment and may be modified in a variety of ways as long as the modifications do not depart from the gist of the present invention.

For example, in the above embodiment, the emergency operation wire 76 is used as the emergency operation member, but the emergency operation member may be one having a rod-shaped portion that is inserted through the grommet 94.

What is claimed is:

1. A lid opening and closing device for a vehicle, comprising a rod capable of moving forward and backward between a pushed-in position, where a lid openably and closably supported on a vehicle body outer plate is pushed in, and a protruding position where the lid is in an open state, a restriction member that is selectively movable between a restriction position, where movement of the rod in a state in which the lid is at a closed position is restricted, and a restriction release position where the restriction is released, an electric motor for driving the restriction member between the restriction position and the restriction release position, a case, housing the restriction member and the electric motor, and configured to be fixed to the vehicle body outer plate, an emergency operation member for extending movably through a vehicle body inner plate while enabling the restriction member to move to the restriction release position when the electric motor malfunctions, and a grommet provided between the emergency operation member and the vehicle body inner plate so as to be capable of preventing water from entering between the vehicle body outer plate and the vehicle body inner plate, the emergency operation member being resiliently urged toward an initial position side at least when being operated, wherein the grommet comprises a grommet main portion configured to be liquid-tightly mounted on the vehicle body inner plate while having the emergency operation member movably inserted therethrough, and an elastic portion integrally connected to the grommet main portion while enabling the emergency operation member to be resiliently urged toward the initial position side, the elastic portion comprising a cylindrical press fit tube portion which has a portion of the emergency operation member press fitted thereinto.

2. The lid opening and closing device for a vehicle according to claim 1, wherein the elastic portion integrally has a bellows portion formed into a bellows shape so as to cover part of the emergency operation member, the bellows portion having one end part thereof integrally connected to the grommet main portion, and the press fit tube portion being formed on another end part of the bellows portion.

3. The lid opening and closing device for a vehicle according to claim 1, wherein the rod is operable to rotate about its axis by 90 degrees when the rod is moved between the pushed-in position and the protruding position.

4. The lid opening and closing device for a vehicle according to claim 1, wherein the rod has a substantially T-shaped engagement portion at a tip end part thereof, which is engagable with a latching part on the lid.

* * * * *